US010062989B2

(12) United States Patent
Little et al.

(10) Patent No.: US 10,062,989 B2
(45) Date of Patent: Aug. 28, 2018

(54) ELECTRICAL CONNECTOR ASSEMBLY

(71) Applicant: FOXCONN INTERCONNECT TECHNOLOGY LIMITED, Grand Cayman (KY)

(72) Inventors: Terrance F. Little, Fullerton, CA (US); Kamyar Khorrami, Orange, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/790,089

(22) Filed: Oct. 23, 2017

(65) Prior Publication Data

US 2018/0115098 A1 Apr. 26, 2018

Related U.S. Application Data

(60) Provisional application No. 62/411,523, filed on Oct. 21, 2016.

(51) Int. Cl.

| | |
|---|---|
| ***H01R 12/00*** | (2006.01) |
| ***H01R 12/71*** | (2011.01) |
| ***H01R 13/6582*** | (2011.01) |
| *H01R 12/70* | (2011.01) |

(52) U.S. Cl.
CPC ..... *H01R 12/716* (2013.01); *H01R 13/6582* (2013.01); *H01R 12/707* (2013.01)

(58) Field of Classification Search
CPC ..... H01R 12/716; H01R 12/7029; H01R 12/707; H01R 13/6582
See application file for complete search history.

(56) References Cited

U.S. PATENT DOCUMENTS

| | | | |
|---|---|---|---|
| 7,901,218 | B2 | 3/2011 | Sato |
| 8,556,640 | B2 | 10/2013 | Mashiyama |
| 8,845,339 | B2 | 9/2014 | Ono |
| 9,331,410 | B2 | 5/2016 | Obikane |
| 9,356,371 | B2 | 5/2016 | Goto |
| 9,362,637 | B2 | 6/2016 | Hasegawa |

(Continued)

FOREIGN PATENT DOCUMENTS

| | | |
|---|---|---|
| CN | 105633673 A | 6/2016 |

*Primary Examiner* — Jean F Duverne
(74) *Attorney, Agent, or Firm* — Wei Te Chung; Ming Chieh Chang

(57) ABSTRACT

A receptacle connector includes an insulative receptacle housing defining two grooves located inside two corresponding lengthwise walls and extending along a longitudinal direction to receive the two lengthwise walls of the plug connector therein. A center island is formed between the two grooves in the transverse direction perpendicular to the longitudinal direction. Two rows of passageways are formed in the corresponding lengthwise walls, respectively, and each passageway communicates with the corresponding groove. Two rows of receptacle contacts are disposed in the corresponding passageways, respectively. Each of the receptacle contacts further includes an upside-down U-shaped structure straddling the lengthwise wall and including an inner part/arm abutting against an interior surface of the lengthwise wall, and an outer part/arm abutting against an exterior surface of the lengthwise wall, wherein the inner part further includes another locking structure to interlock with the locking structure on the corresponding plug contact.

13 Claims, 38 Drawing Sheets

(56) References Cited

U.S. PATENT DOCUMENTS

| | | | | |
|---|---|---|---|---|
| 9,666,963 | B2 | 5/2017 | He | |
| 2009/0197440 | A1* | 8/2009 | Hirata | H01R 12/57 439/83 |
| 2012/0214353 | A1* | 8/2012 | Midorikawa | H01R 12/716 439/733.1 |
| 2013/0012039 | A1* | 1/2013 | Nose | H01R 12/716 439/74 |
| 2013/0316598 | A1* | 11/2013 | Yoshioka | H01R 12/7029 439/733.1 |
| 2013/0330970 | A1* | 12/2013 | Hirata | H01R 12/716 439/620.01 |
| 2014/0099804 | A1* | 4/2014 | Kobuchi | H01R 12/716 439/66 |
| 2014/0363991 | A1* | 12/2014 | Ryan | H01R 12/716 439/74 |
| 2015/0079853 | A1* | 3/2015 | Tsai | H01R 12/716 439/751 |

* cited by examiner

ELECTRICAL CONNECTOR ASSEMBLY

BACKGROUND OF THE INVENTION

1. Field of the Invention

The invention relates to an electrical connector assembly, and particularly to the electrical board-to-board connector assembly.

2. Description of Related Art

A board-to-board electrical connector assembly including the mated receptacle connector and plug connector is desired not only with a low profile but also with some orientation identification structures.

SUMMARY OF THE INVENTION

An invention includes an electrical board-to-board connector assembly including a receptacle connector and a plug connector. The plug connector includes an insulative plug housing forming a mating cavity between two opposite longitudinal walls respectively equipped with two rows of plug contacts by two sides of the mating cavity. Each of the plug contacts includes an upside-down U-shaped structure straddling the longitudinal wall and including an inner arm exposed around an interior face of the corresponding longitudinal wall and an outer arm exposed around an exterior face of the corresponding longitudinal wall. A locking structure is formed in the outer arm. The receptacle connector includes an insulative receptacle housing defining two grooves located inside the corresponding two lengthwise walls and extending along a longitudinal direction to receiving the two lengthwise walls of the plug connector therein. A center island is formed between the two grooves in the transverse direction perpendicular to the longitudinal direction. Two rows of passageways are formed in the corresponding lengthwise walls, respectively, and each passageway communicates with the corresponding groove. Two rows of receptacle contacts are disposed in the corresponding passageways, respectively. Each of the receptacle contacts further includes an upside-down U-shaped structure straddling the lengthwise wall and including an inner part/arm abutting against an interior surface of the lengthwise wall, and an outer part/arm abutting against an exterior surface of the lengthwise wall wherein the inner part further includes another locking structure to interlock with the locking structure on the corresponding plug contact. The inner part is further equipped with an L-shaped extension to commonly form an upstanding U-shaped structure so as to receive and electrically and mechanically connect the upside-down U-shaped structure of the plug contact during mating. The receptacle connector optionally further includes a metallic shell enclosing the receptacle housing and unitarily forming a plurality of spring tangs extending into the corresponding passageways to replace the receptacle contacts, respectively. A portion of the lengthwise wall is thickened to allow the metallic shell attached upon the exterior surface. The center island may optionally form a pair of alignment holes to receive the corresponding optional pair of alignment poles extending from the mating cavity of the plug connector wherein the pair of alignment holes may be differently sized and the pair of alignment poles as well for single orientation consideration.

In another embodiment, the upside-down U-shaped structure of the receptacle contact is shorten with less than one half of the height of the lengthwise wall, and no longer straddles the corresponding lengthwise wall for retention but using barbed structures on the outer part of the upside-down U-shaped structure to retain the corresponding receptacle contact with in the corresponding passageway. Other objects, advantages and novel features of the invention will become more apparent from the following detailed description when taken in conjunction with the accompanying drawings.

DETAILED DESCRIPTION OF THE PREFERRED EMBODIMENT

Figure 1A:
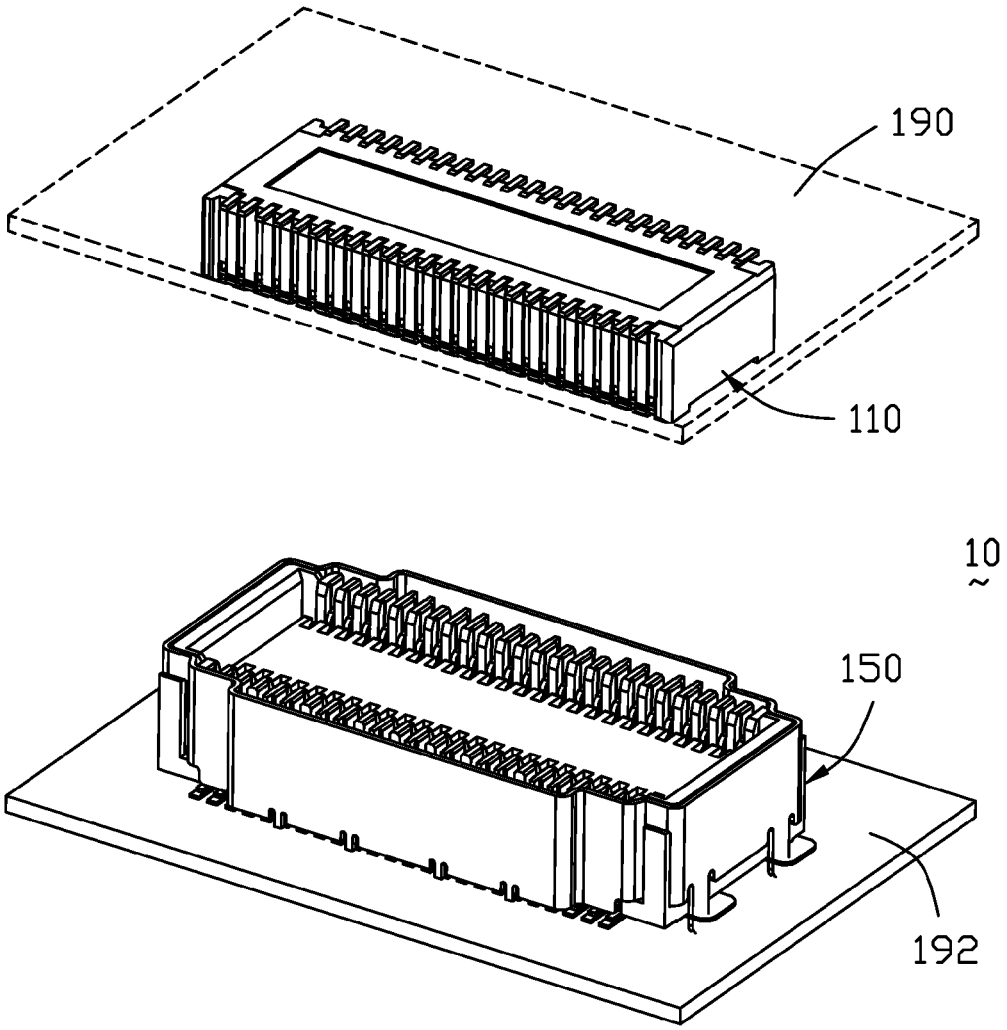
FIG. 1(A) is a downward perspective view of an electrical connector assembly including the receptacle connector and the plug connector respectively mounted upon the corresponding printed circuit boards, respectively, according to a first embodiment of the invention.
Figure 1B:
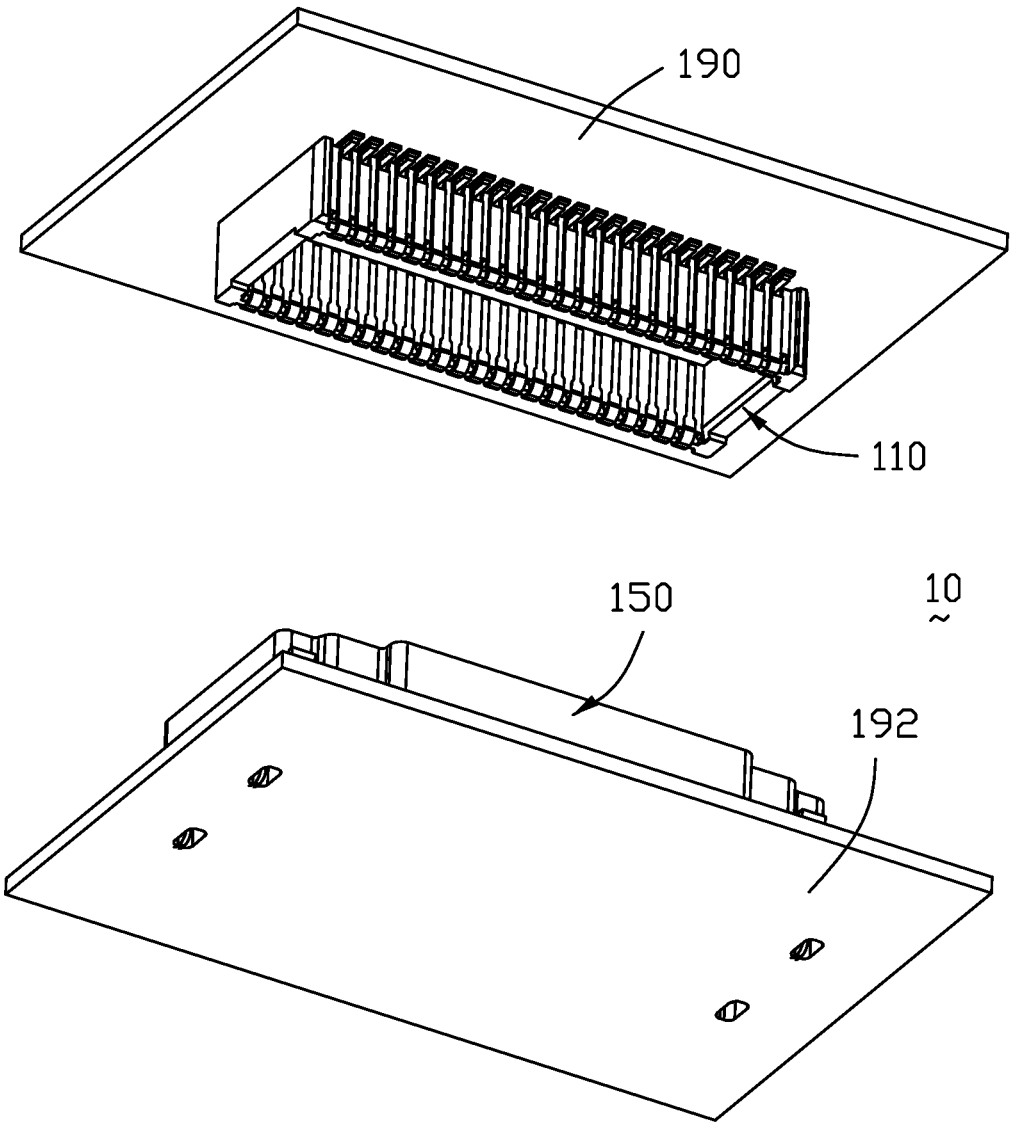
FIG. 1(B) is an upward perspective view of the electrical connector assembly of FIG. 1(A)
Figure 2A:
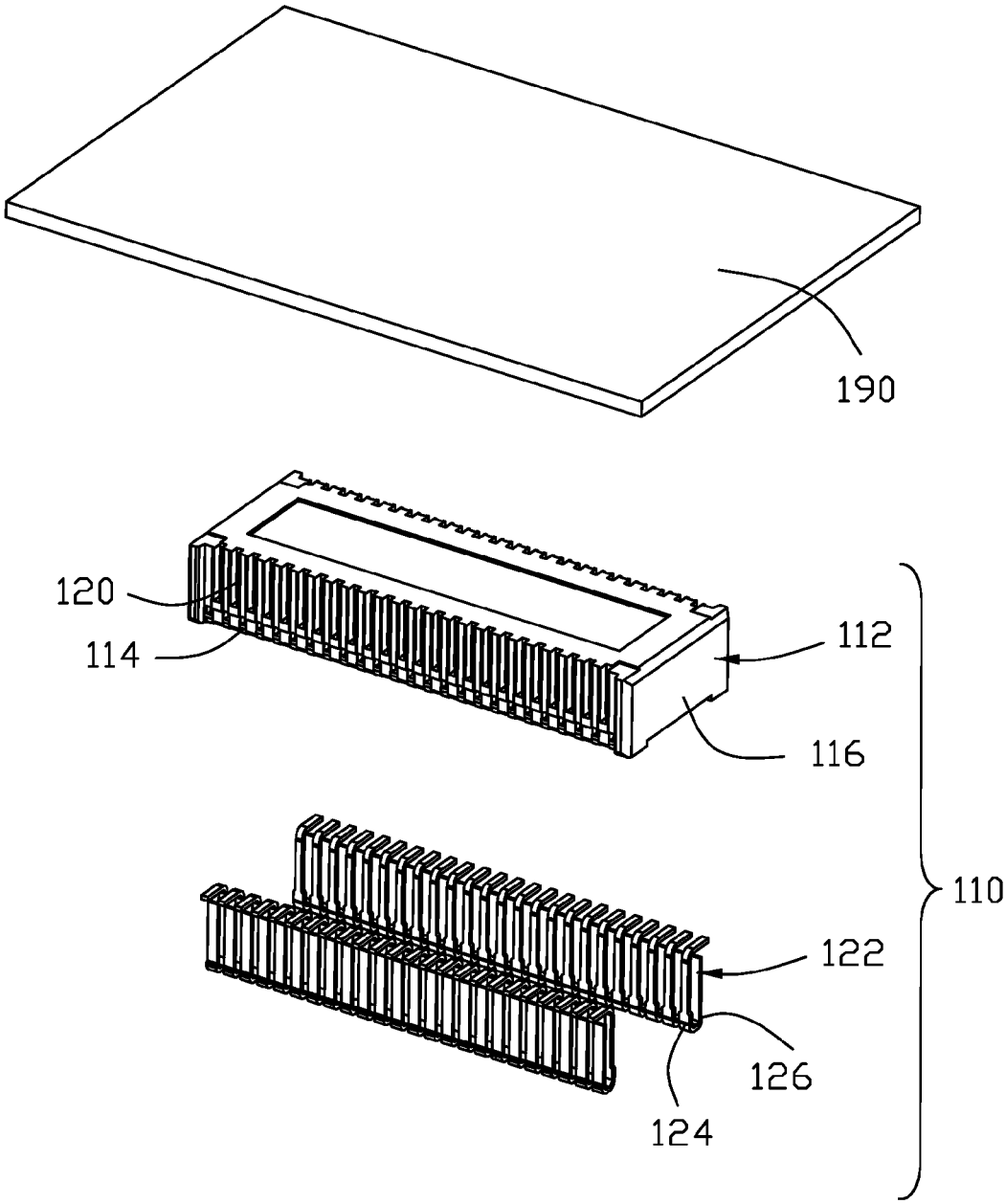
FIG. 2(A) is the downward exploded view of the plug connector and the corresponding printed circuit board of FIG. 1(A)
Figure 2B:
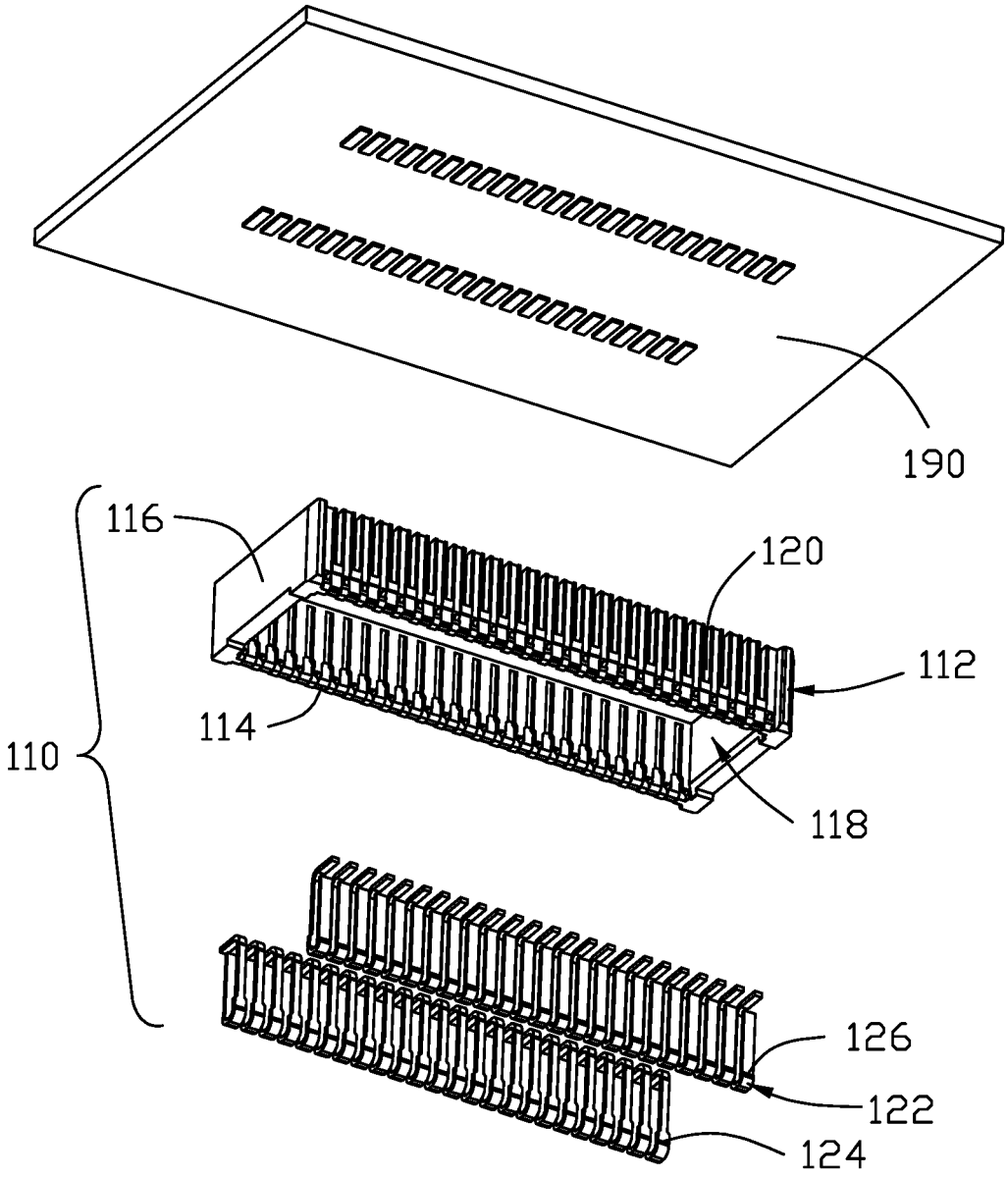
FIG. 2(B) is an upward exploded perspective view of the plug connector and the corresponding printed circuit board of FIG. 2(A)
Figure 3A:
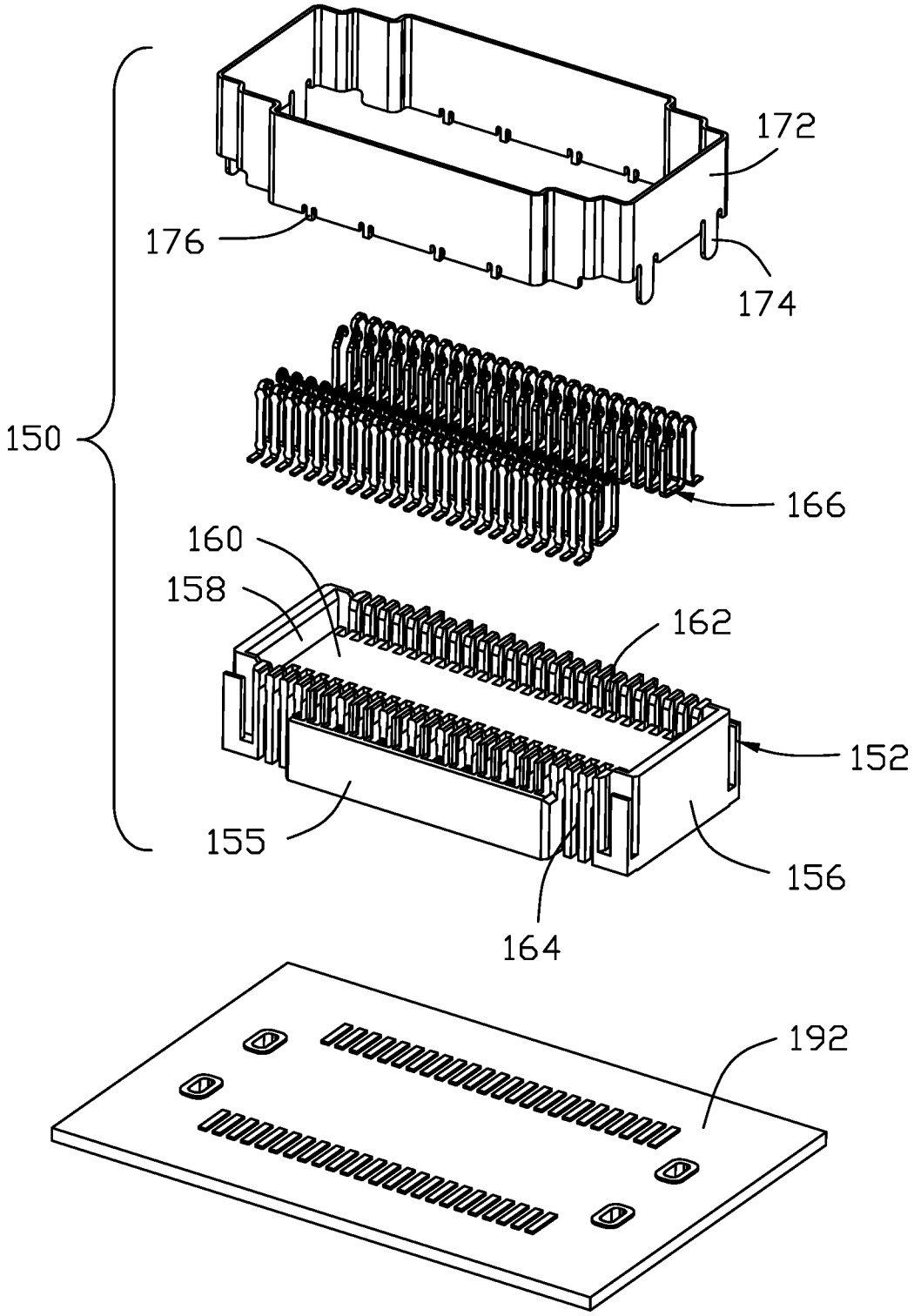
FIG. 3(A) is a downward exploded perspective view of the receptacle connector and the corresponding printed circuit board of FIG. 1(A)
Figure 3B:
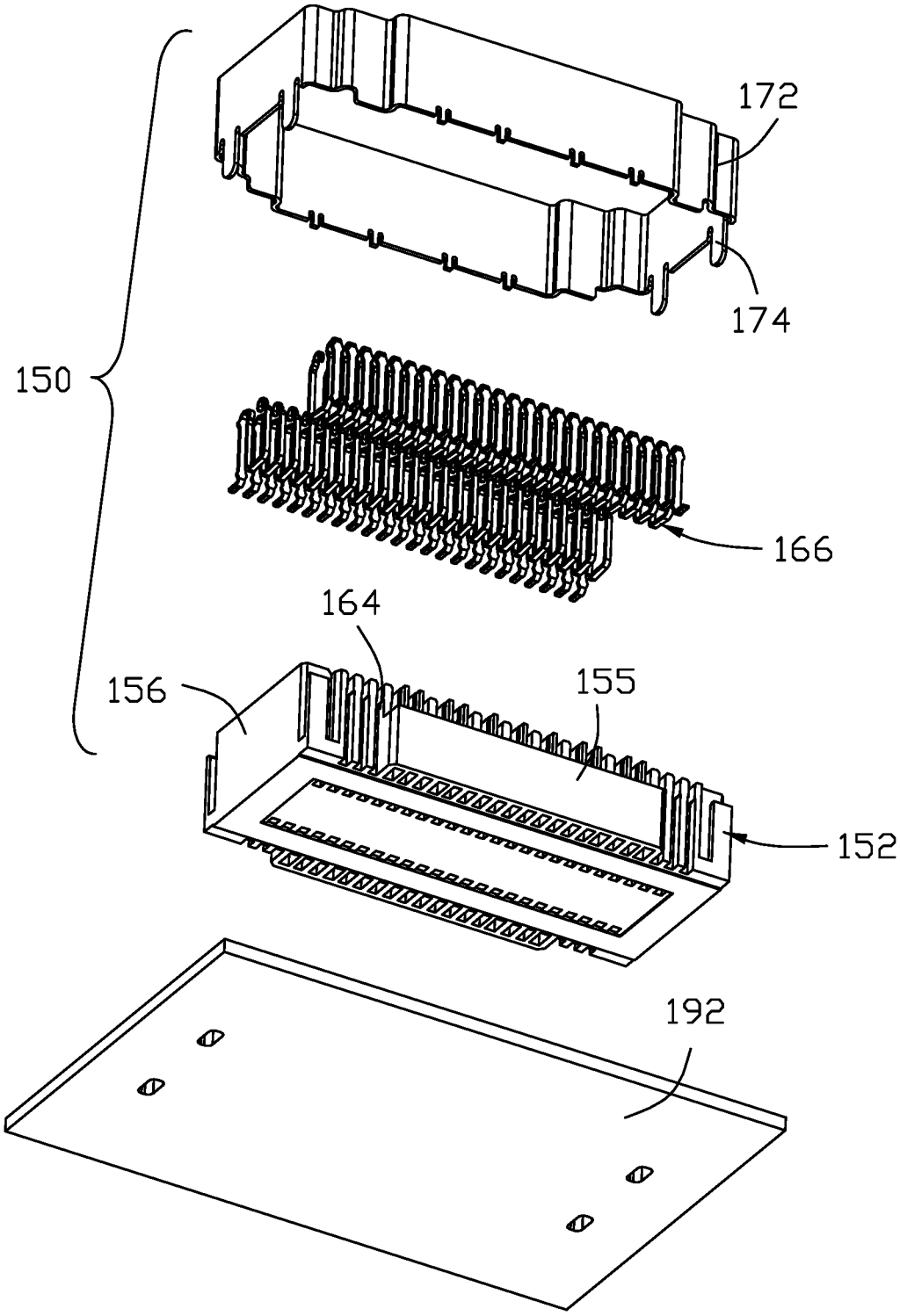
FIG. 3(B) is an upward exploded perspective view of the receptacle connector and the corresponding printed circuit board of FIG. 3(A)
Figure 4A:
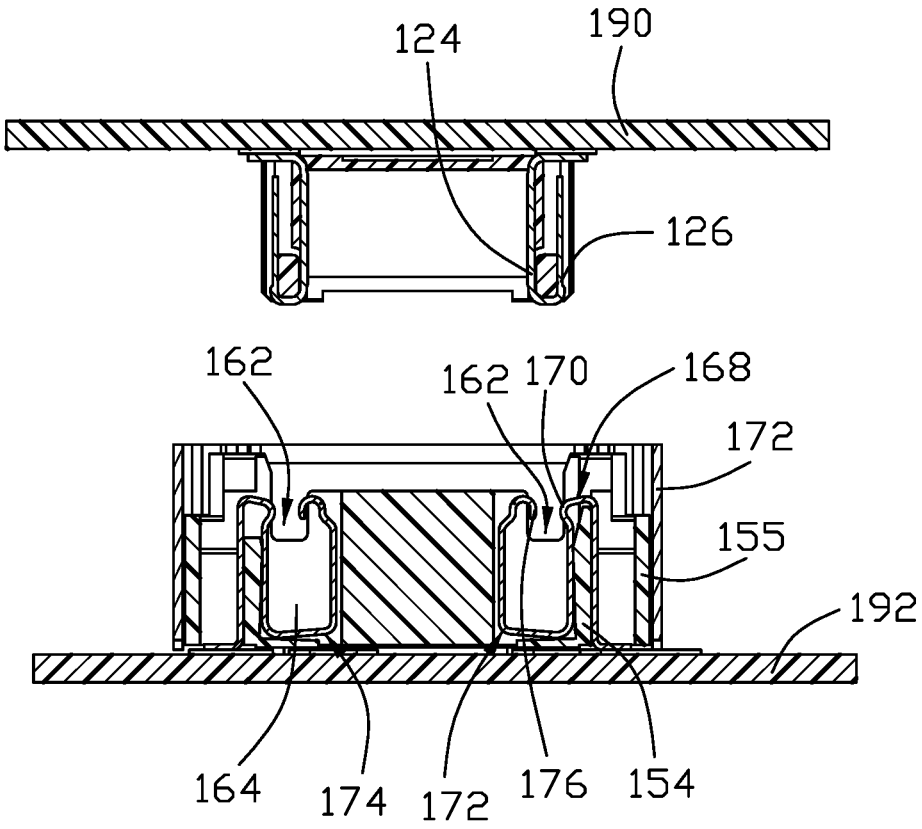
FIG. 4(A) is a cross-sectional view of the electrical connector assembly of FIG. 1(A) when the receptacle connector and the plug connector are not mated with each other.
Figure 4B:
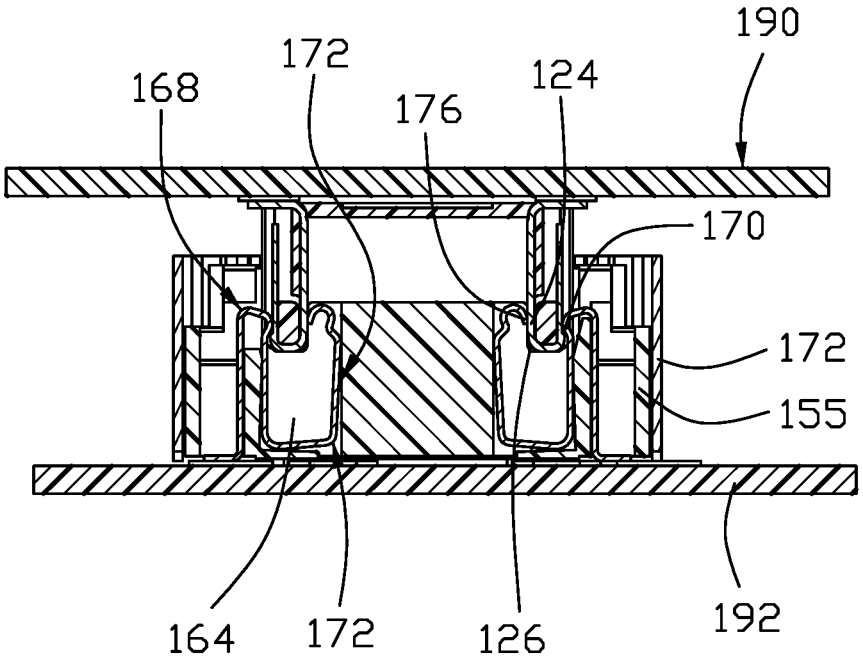
FIG. 4(B) is a cross-sectional view of the electrical connector assembly of FIG. 1(A) when the receptacle connector and the plug connector are mated with each other.

Referring to FIGS. 1(A)-4(B), an electrical connector assembly 10 includes a plug connector 110 mounted upon a printed circuit board 190 for mating with a receptacle connector 150 mounted upon another printed circuit board 192. The plug connector includes an insulative housing 112 defining a pair of opposite longitudinal walls 114 extending along a longitudinal direction and a pair of opposite transverse walls 116 extending along a transverse direction perpendicular to the longitudinal direction for cooperating with the pair of longitudinal walls 114 to commonly form a receiving cavity 118. Two rows of passageways 120 are formed in the two longitudinal wall 114, respectively, and two rows of contacts 122 are disposed in the corresponding passageways 120, respectively. The contact 122 include opposite inner contacting region 124 and outer contacting/locking region 126 respectively located on opposite interior and exterior surfaces of the corresponding longitudinal wall 114. The receptacle connector 150 includes an insulative housing 152 defining a pair of opposite lengthwise walls 154 in a longitudinal direction and a pair of opposite transverse walls 156 for cooperating with the pair of lengthwise walls to form a receiving cavity 158 in which a center island 160 upwardly extends. The receiving cavity 158 includes a pair of grooves 162 to receive the corresponding longitudinal walls 114 therein, respectively. Two rows of passageways 164 are formed in the housing 152 including the corresponding lengthwise walls 114, respectively. Two rows of contacts 166 are respectively disposed in the corresponding passageways 164, respectively. Each contact 166 includes an upside-down U-shaped structure 168 straddling the lengthwise wall 154 and forming an outer locking/contacting section 170, and an L-shaped extension 172 unitarily extends from the inner arm of the upside-down U-shaped structure 168 to commonly form an upstanding U-shaped structure 174 with an inner contacting section 176 opposite to the inner contacting section 170 with the corresponding groove 162 therebetween in the transverse direction. The lengthwise wall 154 forms a thickened section 155 to protectively hide the corresponding passageways 164 and the corresponding contacts 166. A metallic shield 172 surrounds the housing 152 with mounting legs 174 mounted to the printed circuit board 192 and with contacting tabs 176 to contact the corresponding grounding ones of the corresponding contact 166.

Figure 5A:
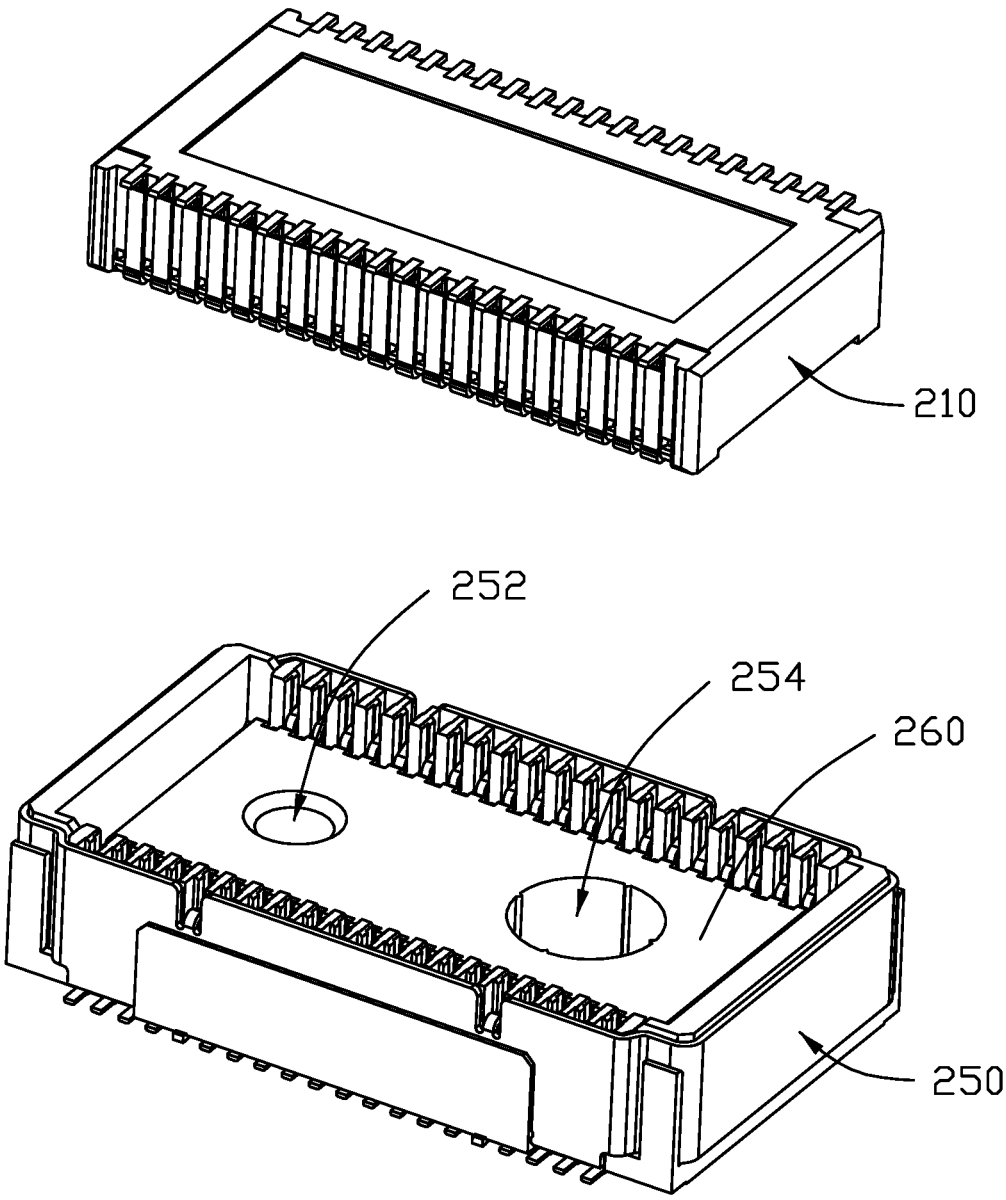
FIG. 5(A) is a downward perspective view of the electrical connector assembly including a plug connector and a receptacle connector according to the second embodiment of the invention.
Figure 5B:
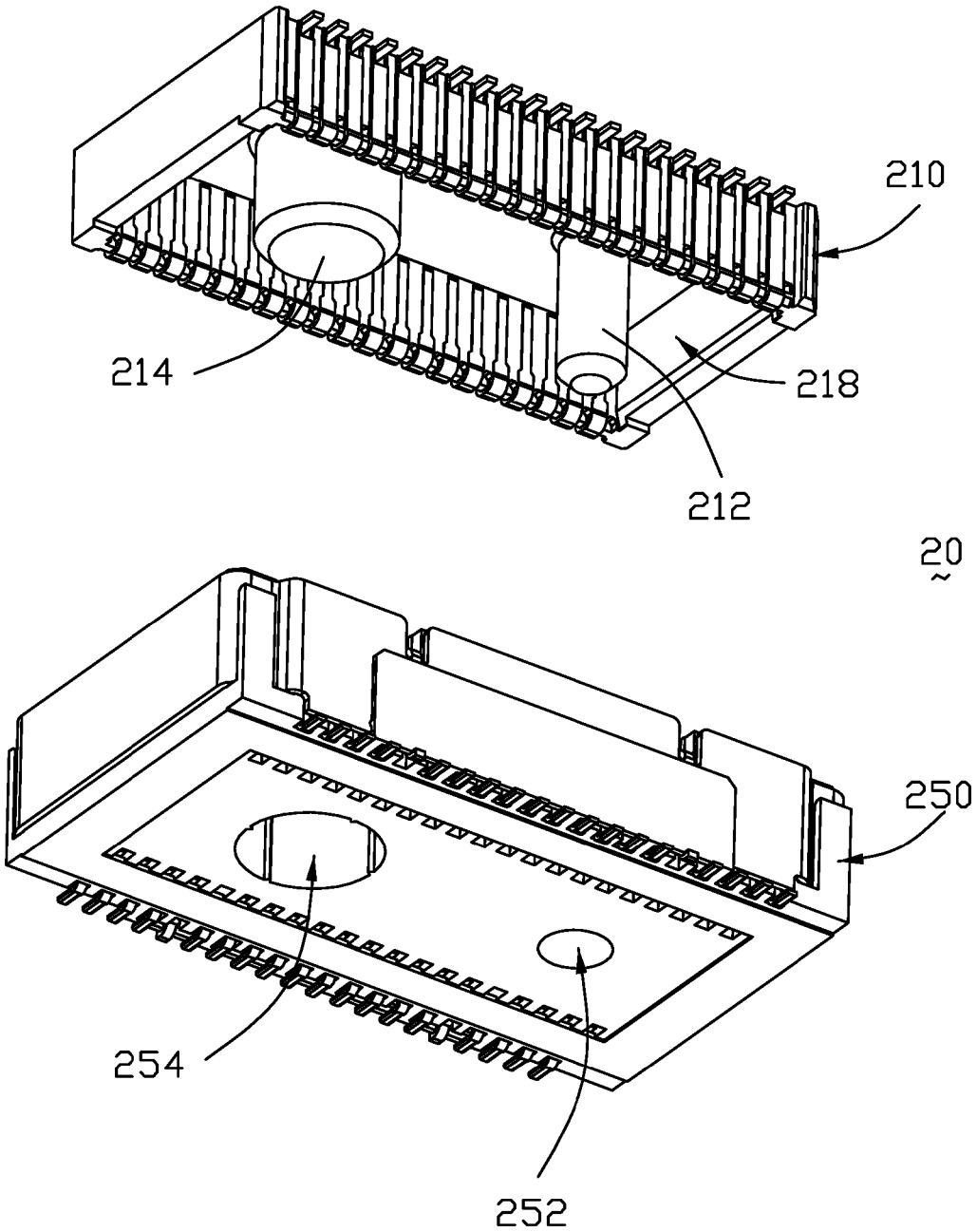
FIG. 5(B) is an upward perspective view of the electrical connector assembly of FIG. 5(A)
Figure 6A:
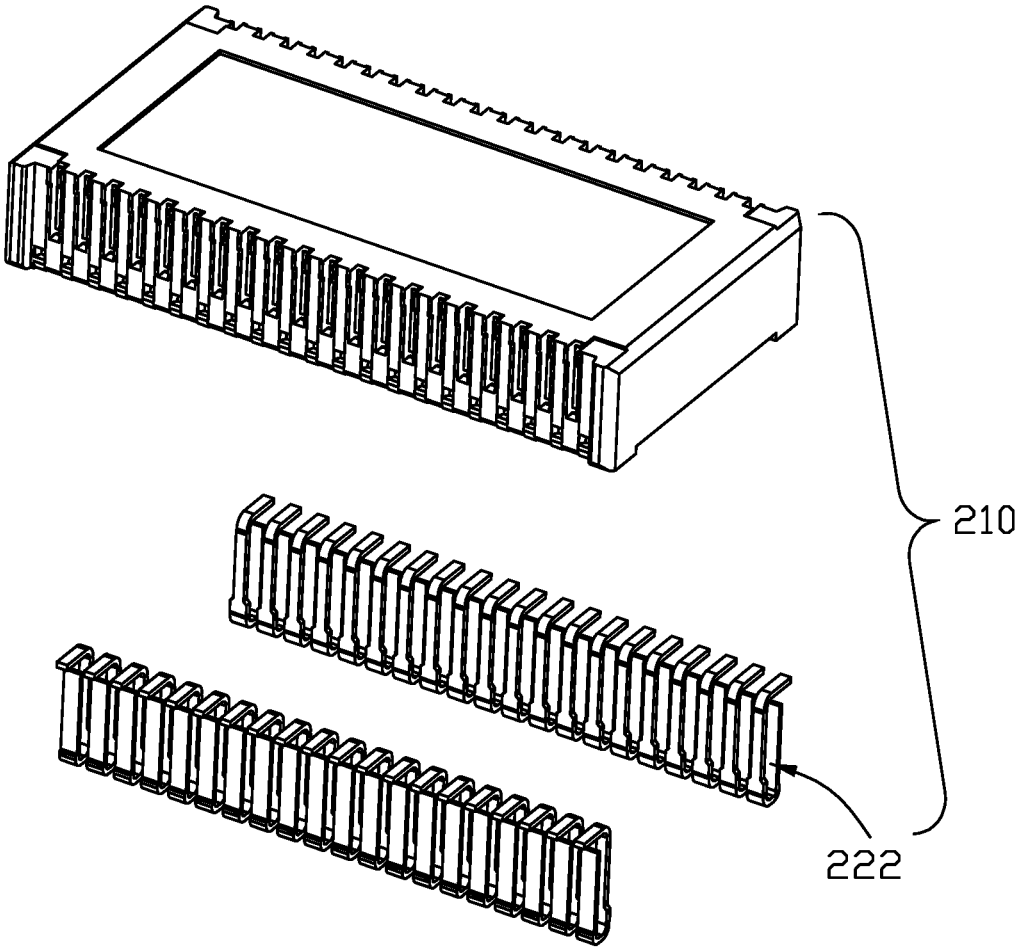
FIG. 6(A) is a downward exploded perspective view of the plug connector of FIG. 5(A)
Figure 6B:
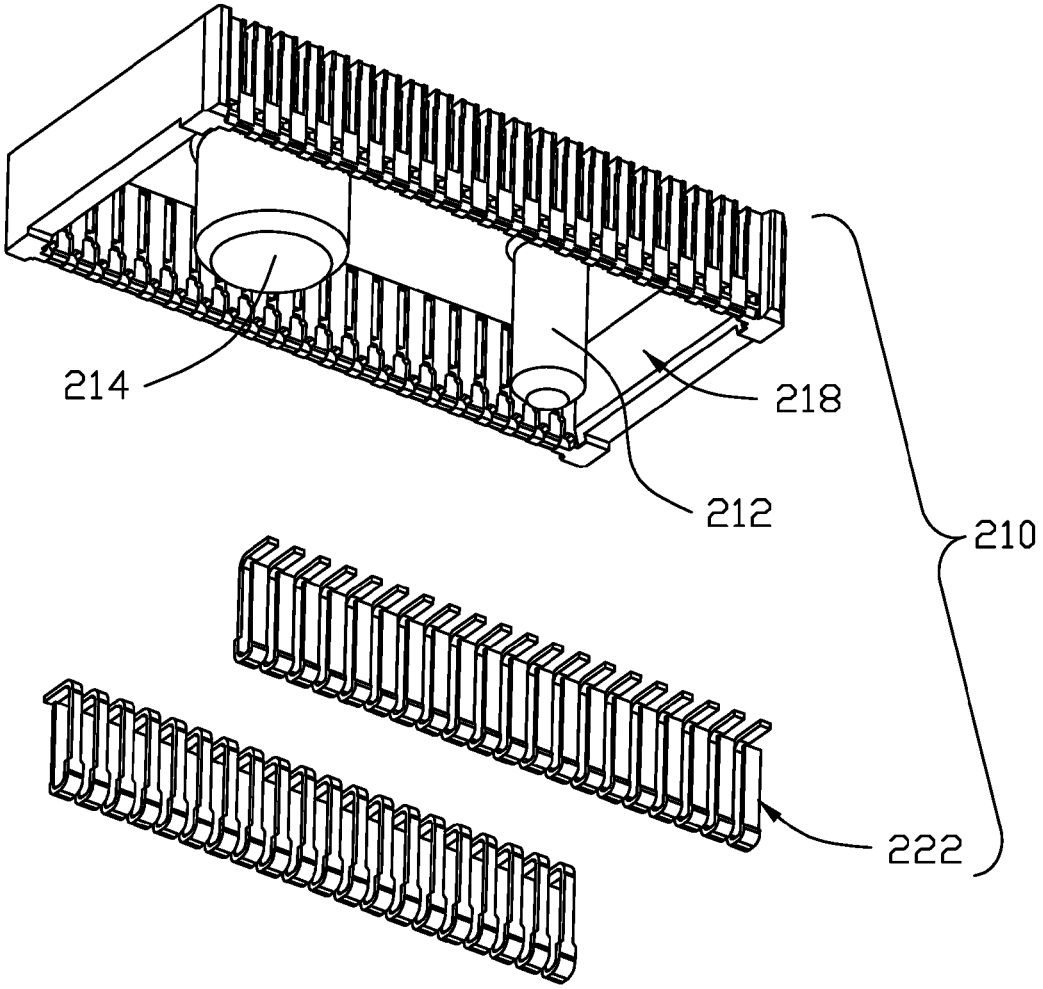
FIG. 6(B) is an upward exploded perspective view of the plug connector of FIG. 5(A)
Figure 7A:
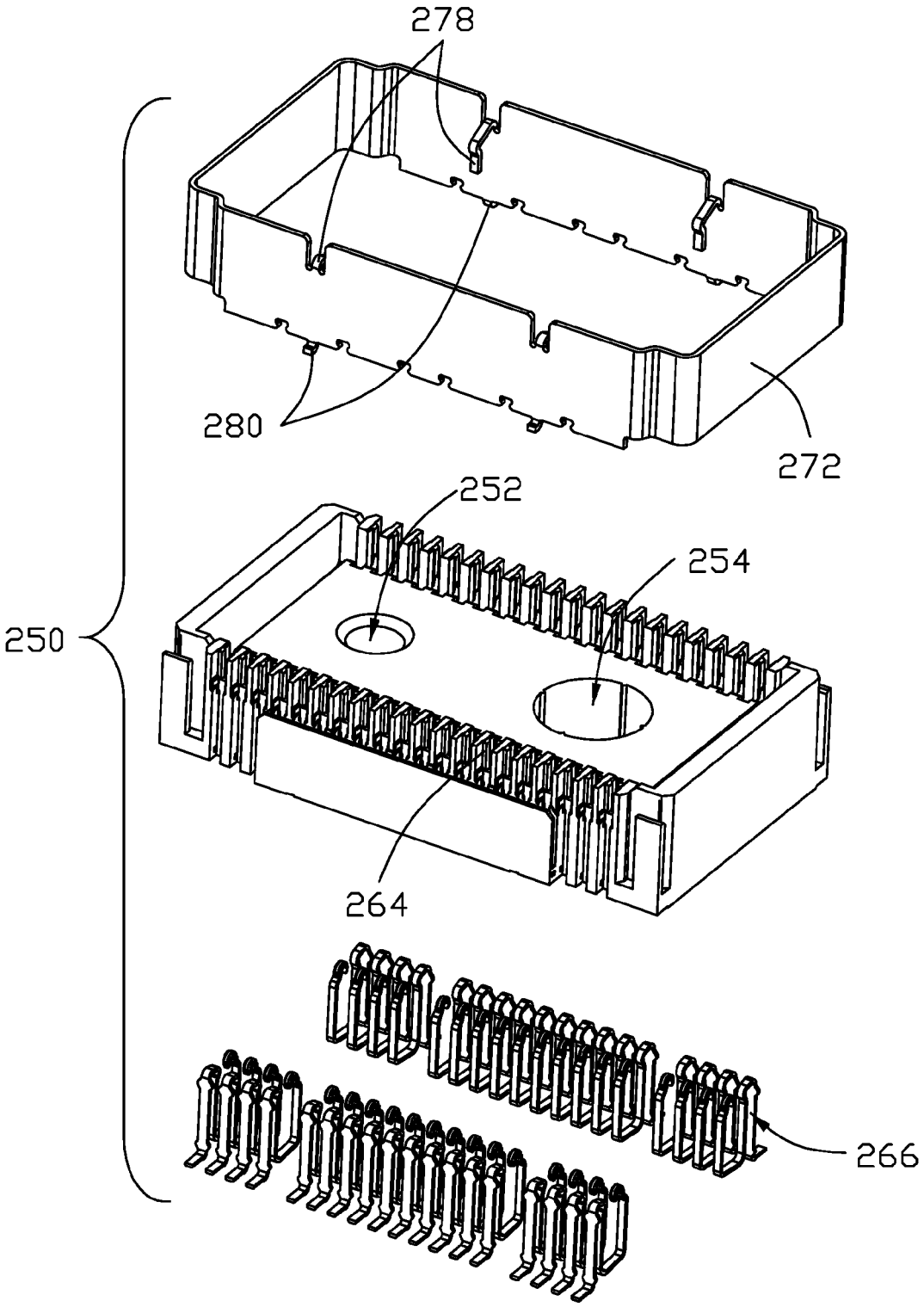
FIG. 7(A) is a downward exploded perspective view of the receptacle connector of FIG. 5(A)
Figure 7B:
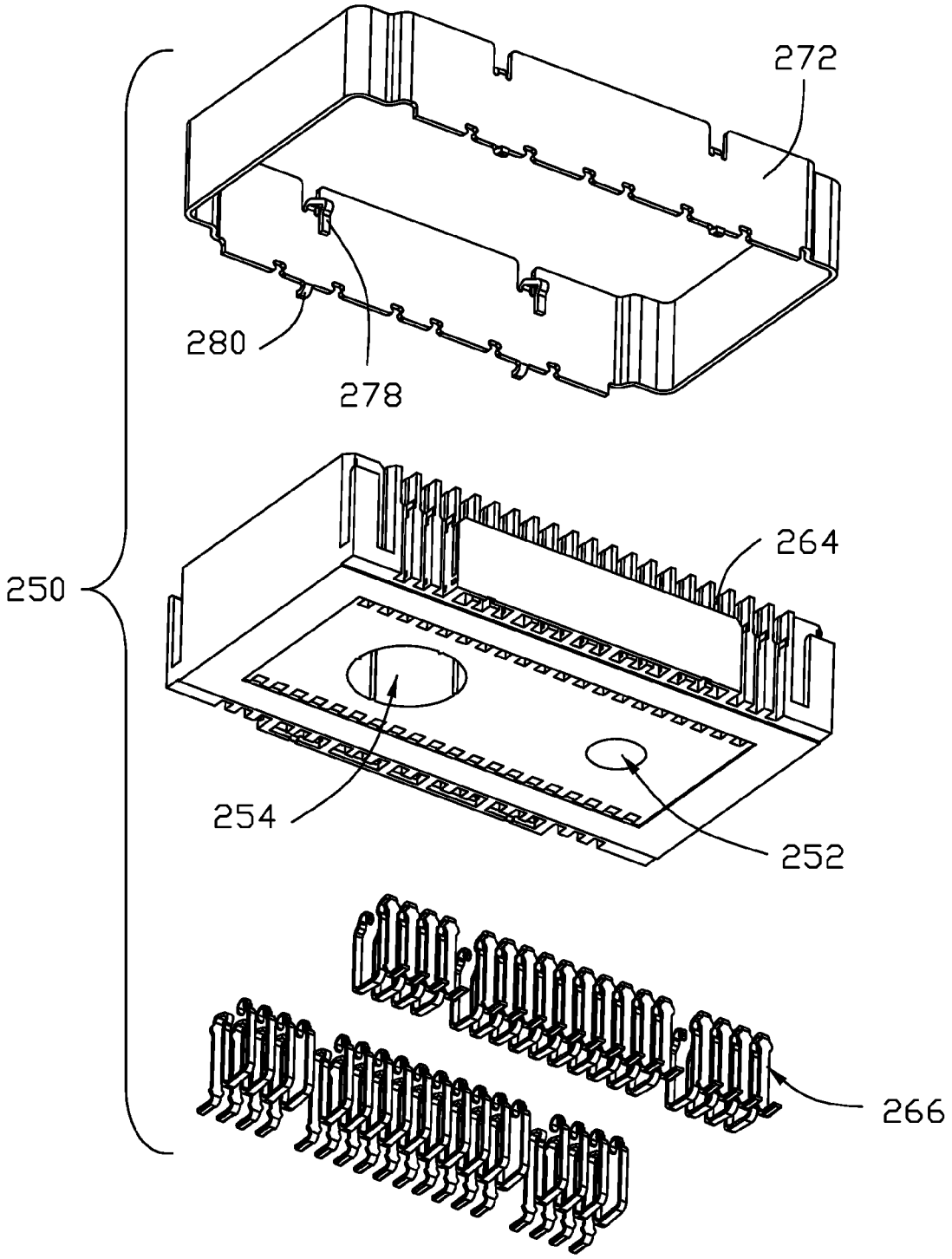
FIG. 7(B) is a downward perspective view of the receptacle connector of FIG. 5(A)
Figure 8A:
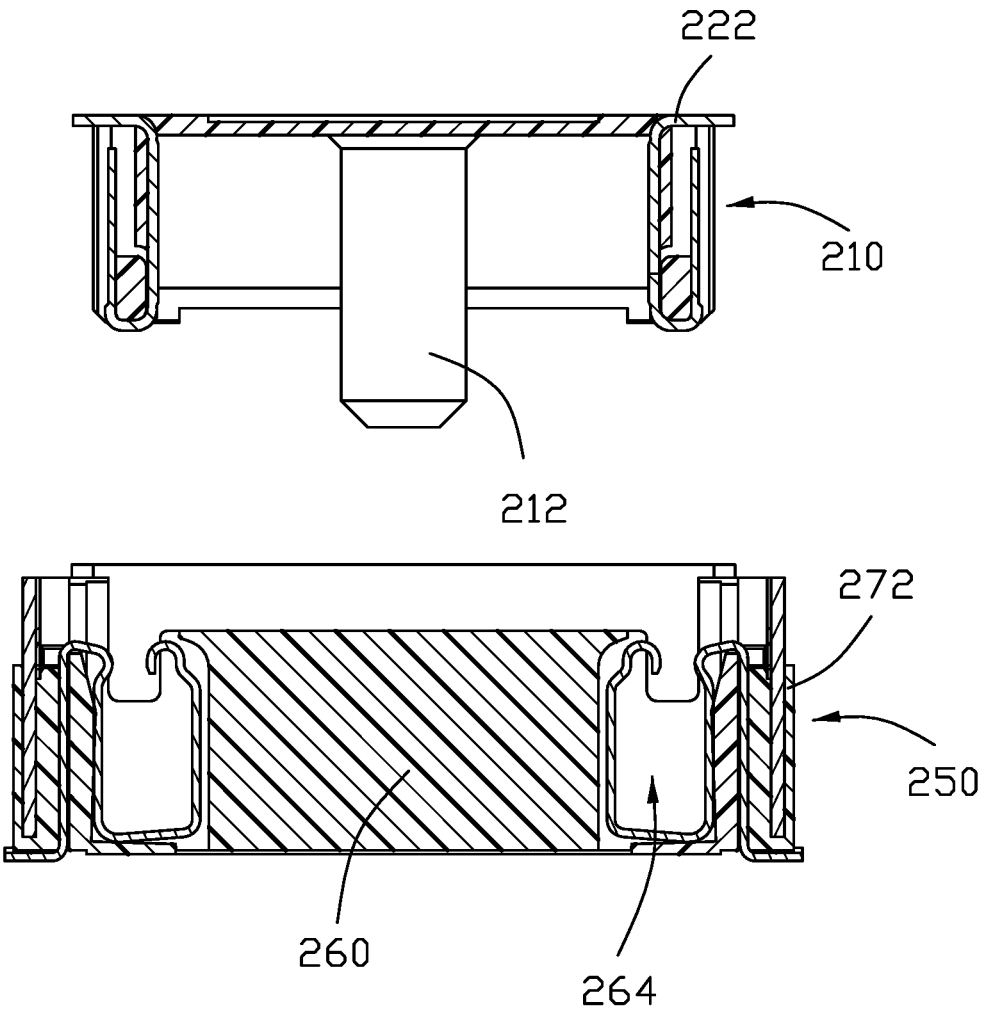
FIG. 8(A) is a cross-sectional view, taken along a transverse plane, of the electrical connector assembly of FIG. 5(A) when the plug connector and the receptacle connector are not mated with each other.
Figure 8B:
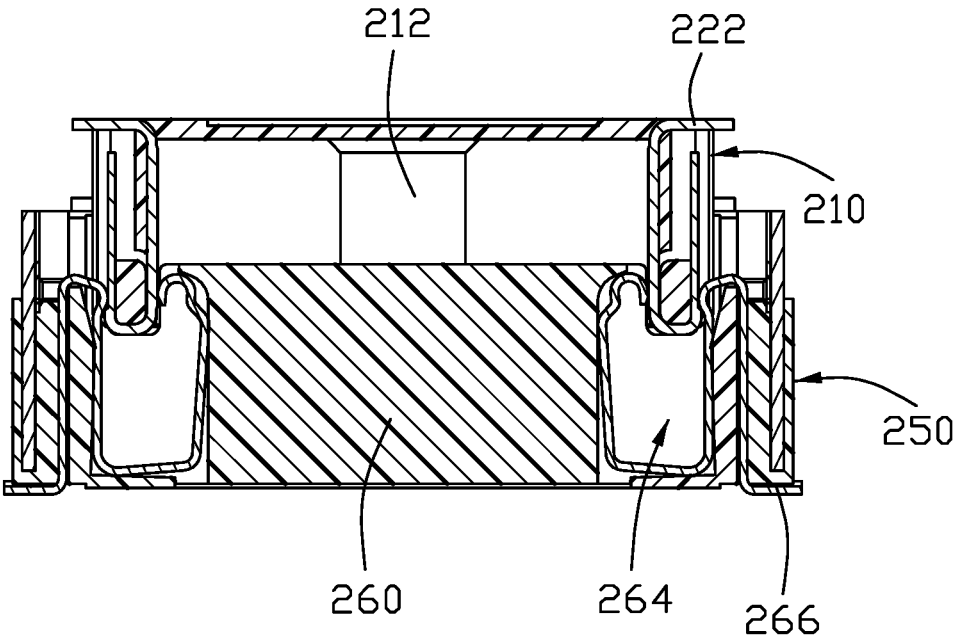
FIG. 8(B) is a cross-sectional view of the electrical connector assembly of FIG. 8(A) when the plug connector and the receptacle connector are mated with each other.
Figure 9A:
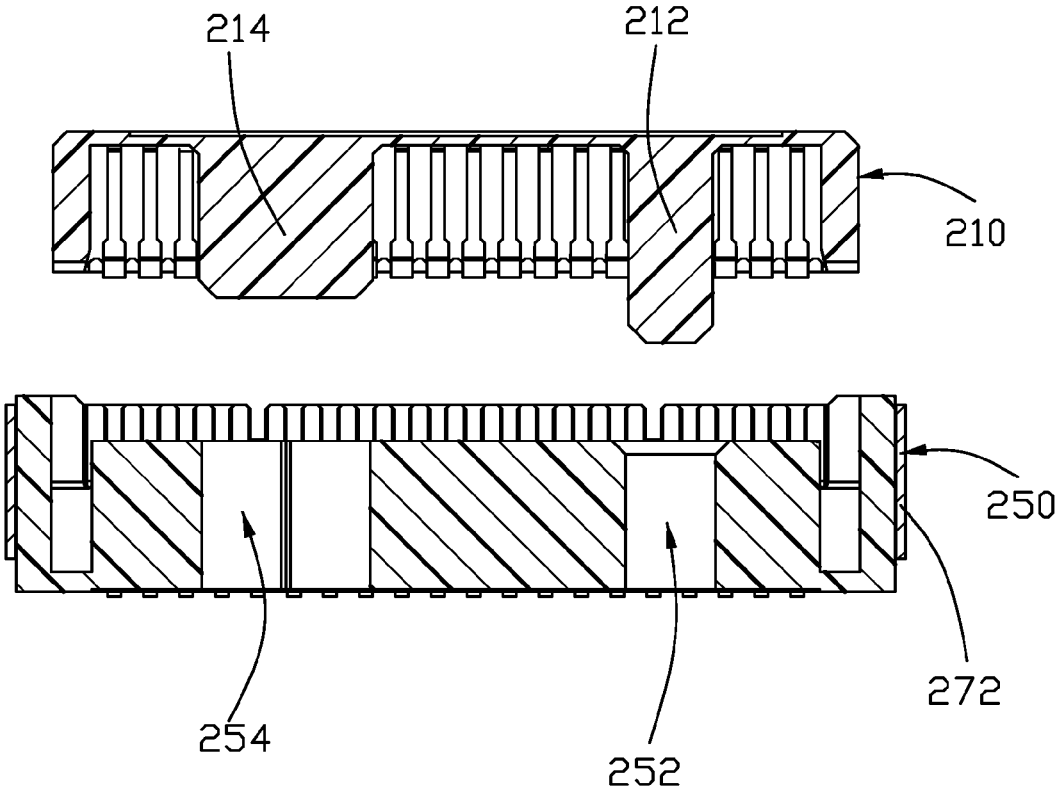
FIG. 9(A) is a cross-sectional view, taken along a longitudinal plane, of the electrical connector assembly of FIG. 5(A) when the plug connector and the receptacle connector are not mated with each other.
Figure 9B:
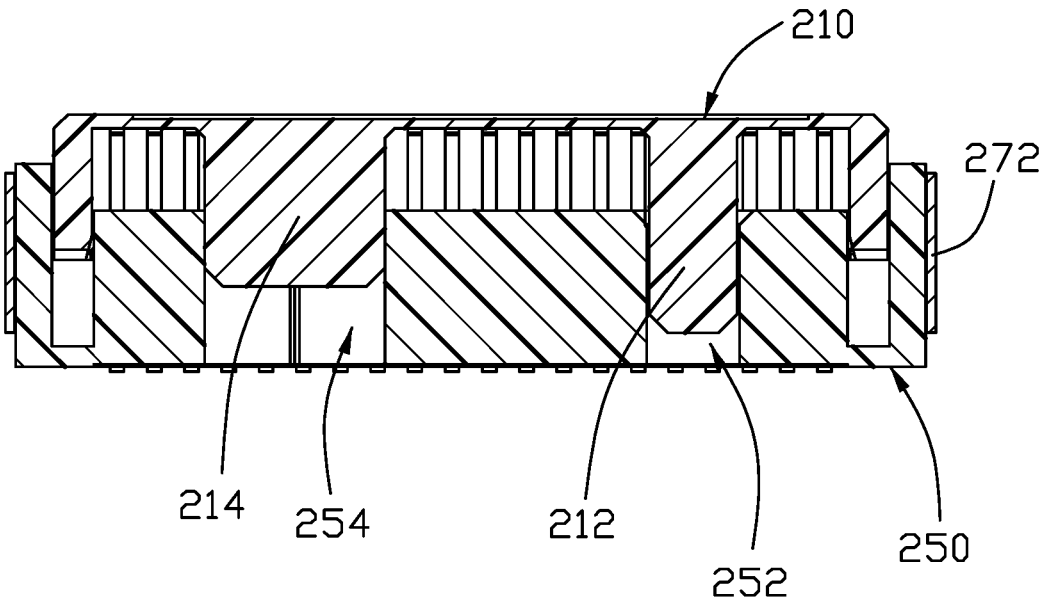
FIG. 9(B) is a cross-sectional view of the electrical connector assembly of FIG. 9(A) when the plug connector and the receptacle connector are mated with each other.
Figure 10A:
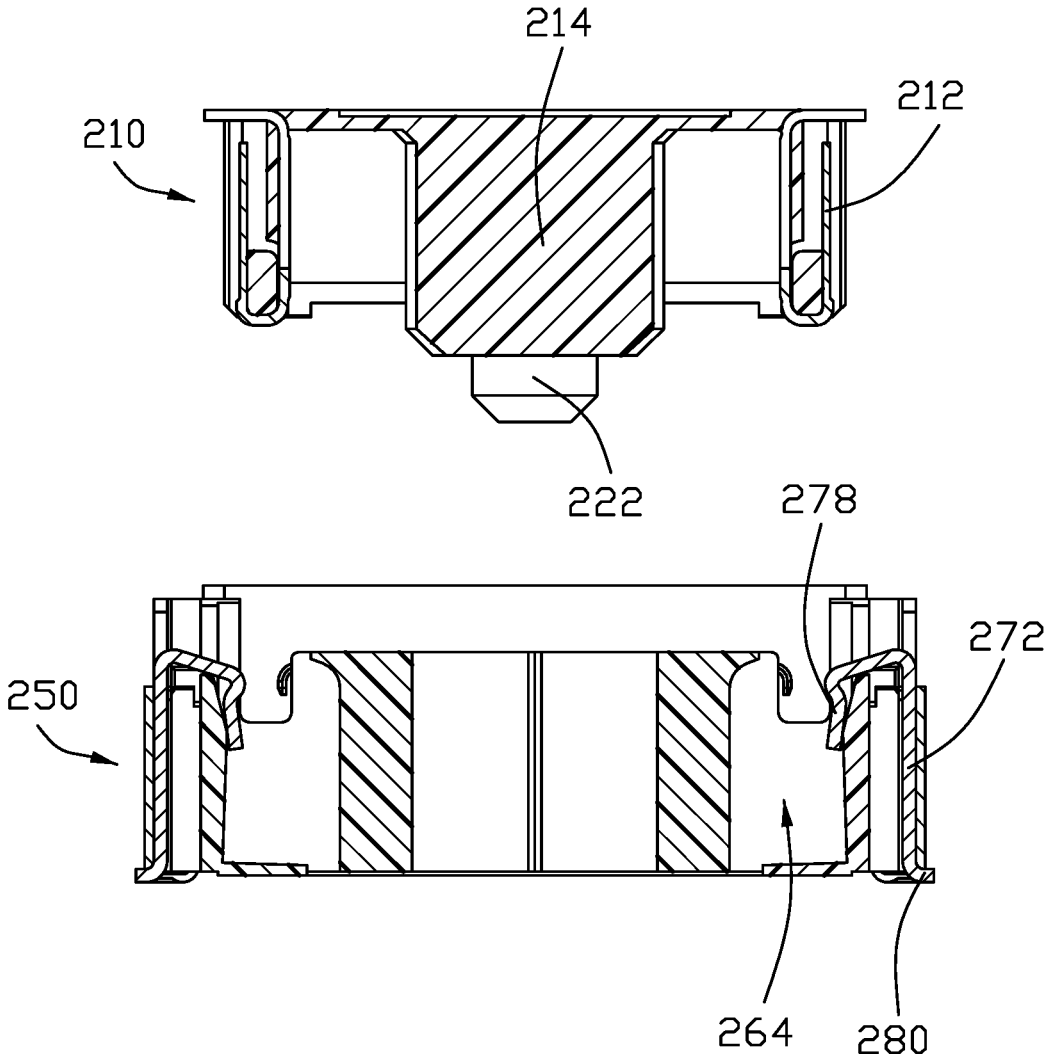
FIG. 10(A) is another cross-sectional view taken along another transverse plane, of the electrical connector assembly of FIG. 5(A) when the plug connector and the receptacle connector are not mated with each other.
Figure 10B:
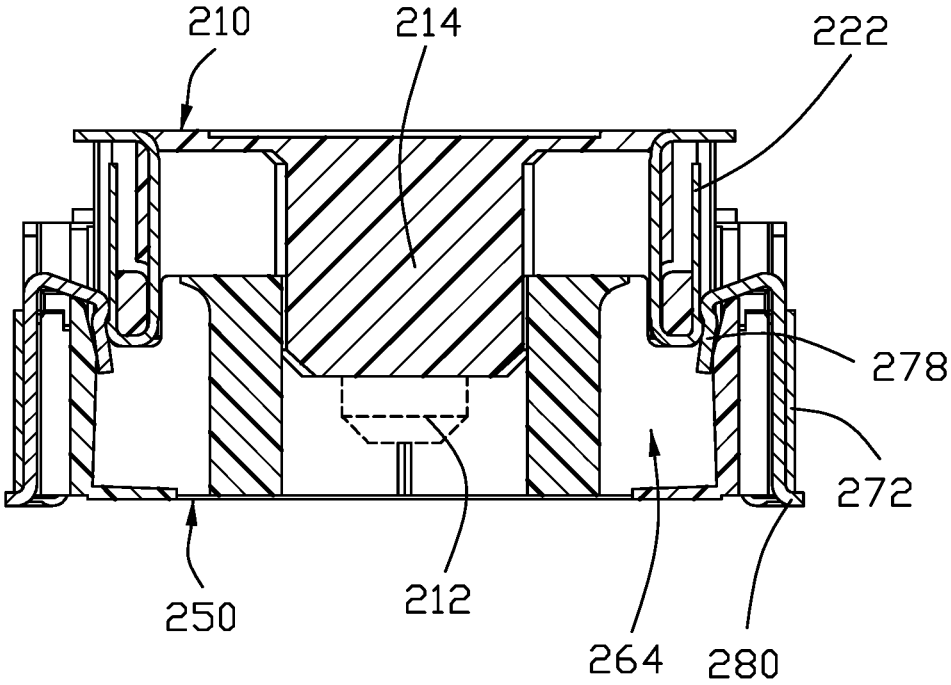
FIG. 10(B) is another cross-sectional view of the electrical connector assembly of FIG. 10(A) when the plug connector and the receptacle connector are mated with each other.

Referring to FIGS. 5(A)-10(B), the electrical connector assembly 20 includes a plug connector 210 and a receptacle connector 250 for mating with each other. The plug connector 210 is similar to the plug connector 110, and the receptacle connector 250 is similar to the receptacle 150 except that the plug connector 210 includes a pair of different sized poles 212 and 214 in the mating cavity 218, and the center island 260 of the receptacle connector 250 forms a pair of different sized holes 252 and 254 to receive the corresponding poles 212 and 214, respectively, in a specific orientation. Moreover, the grounding ones of the receptacle contacts 266 are missing and instead the metallic shield 272 further includes the spring tangs 278 extending from the metallic shield 272 into the corresponding passageways 264 to contact the corresponding plug contacts 222, and the solder tails 280 for surface-mounting to the corresponding pads on the printed circuit board on which the receptacle connector 250 is seated.

Figure 11A:
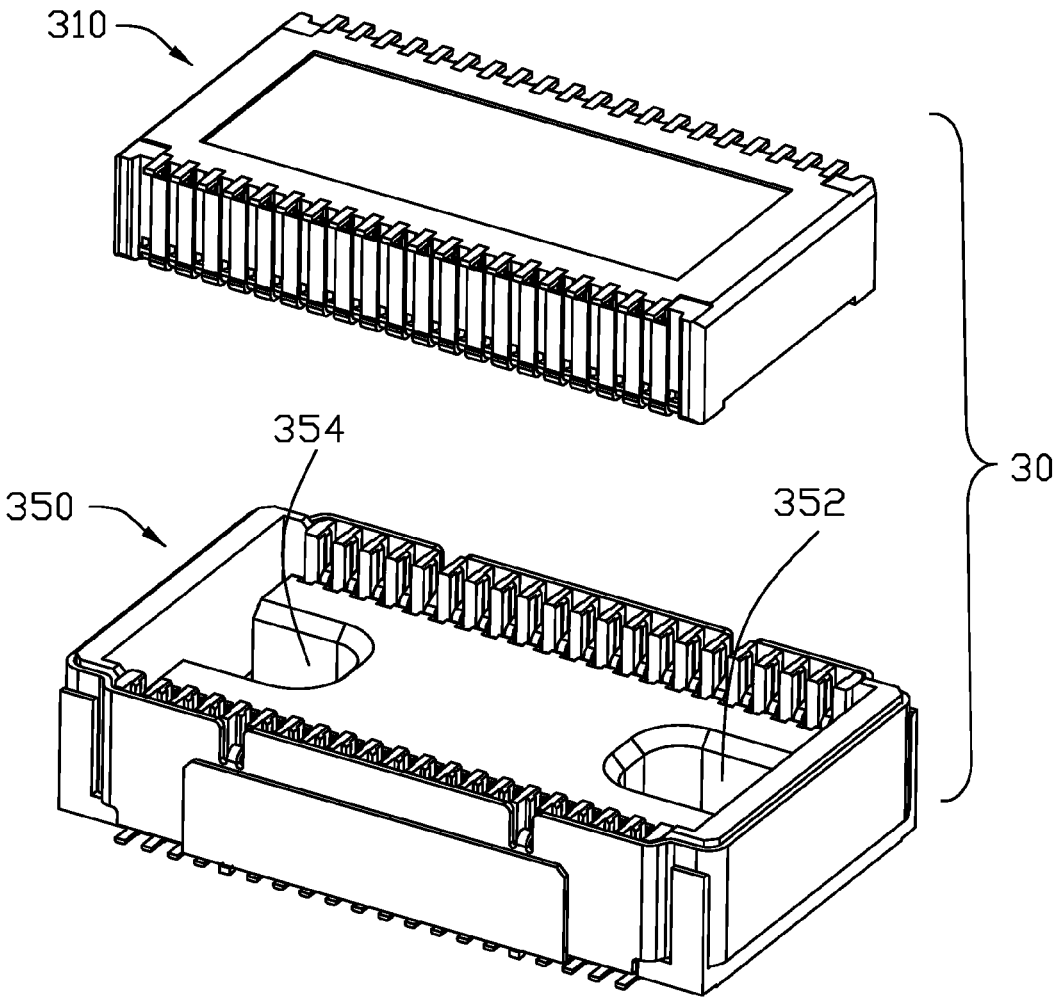
FIG. 11(A) is a downward perspective view of the electrical connector assembly including a plug connector and a receptacle connector according to the third embodiment of the invention.
Figure 11B:
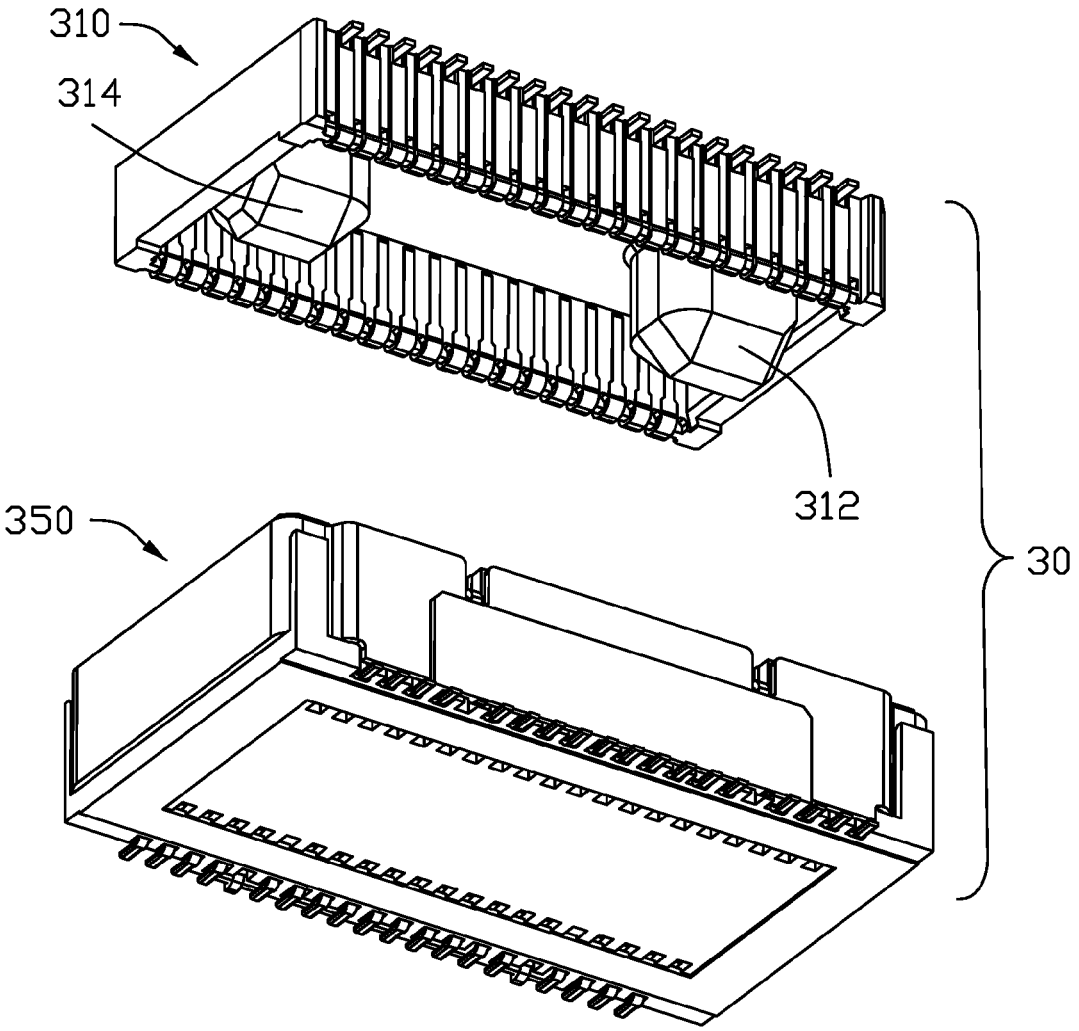
FIG. 11(B) is an upward perspective view of the electrical connector assembly of FIG. 11(A)
Figure 12A:
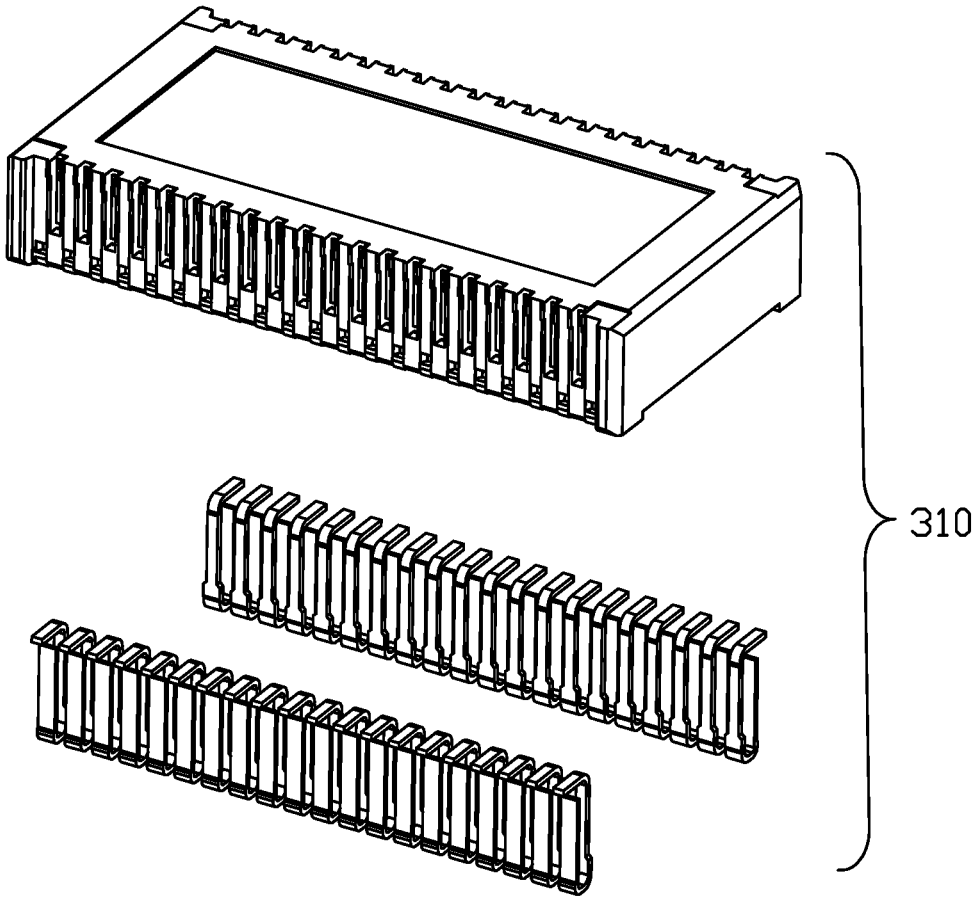
FIG. 12(A) is a downward exploded perspective view of the plug connector of FIG. 11(A)
Figure 12B:
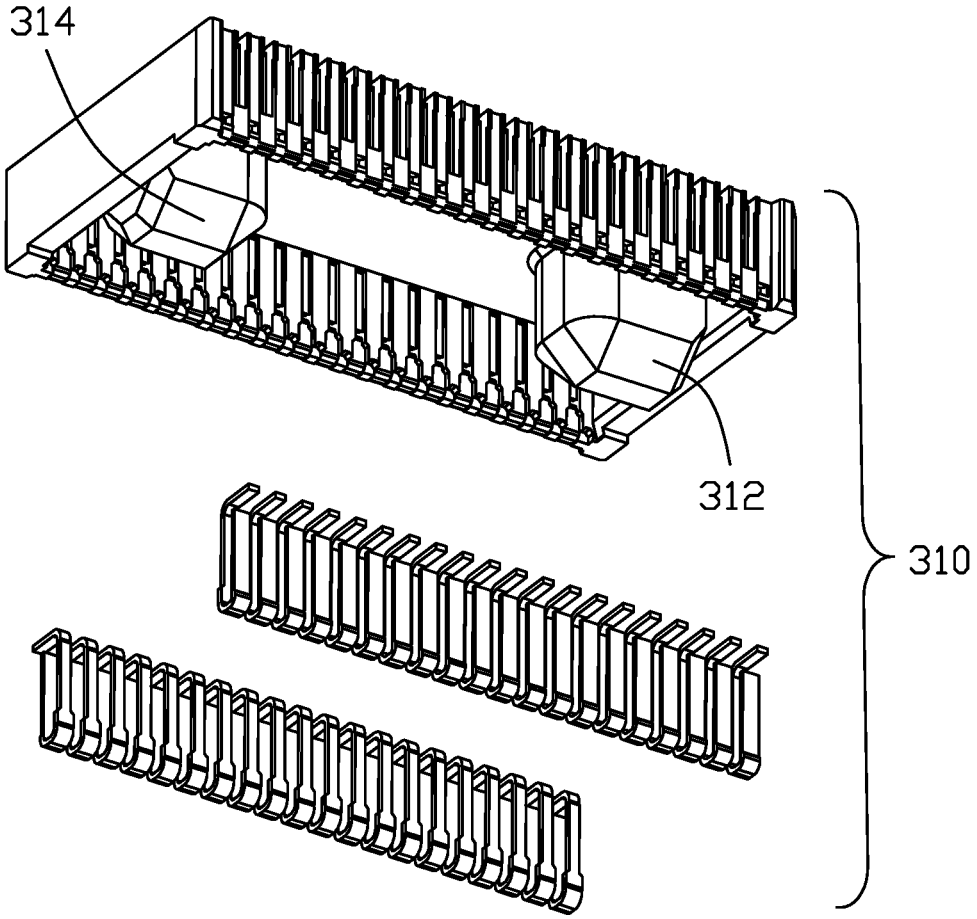
FIG. 12(B) is an upward exploded perspective view of the plug connector of FIG. 11(A)
Figure 13A:
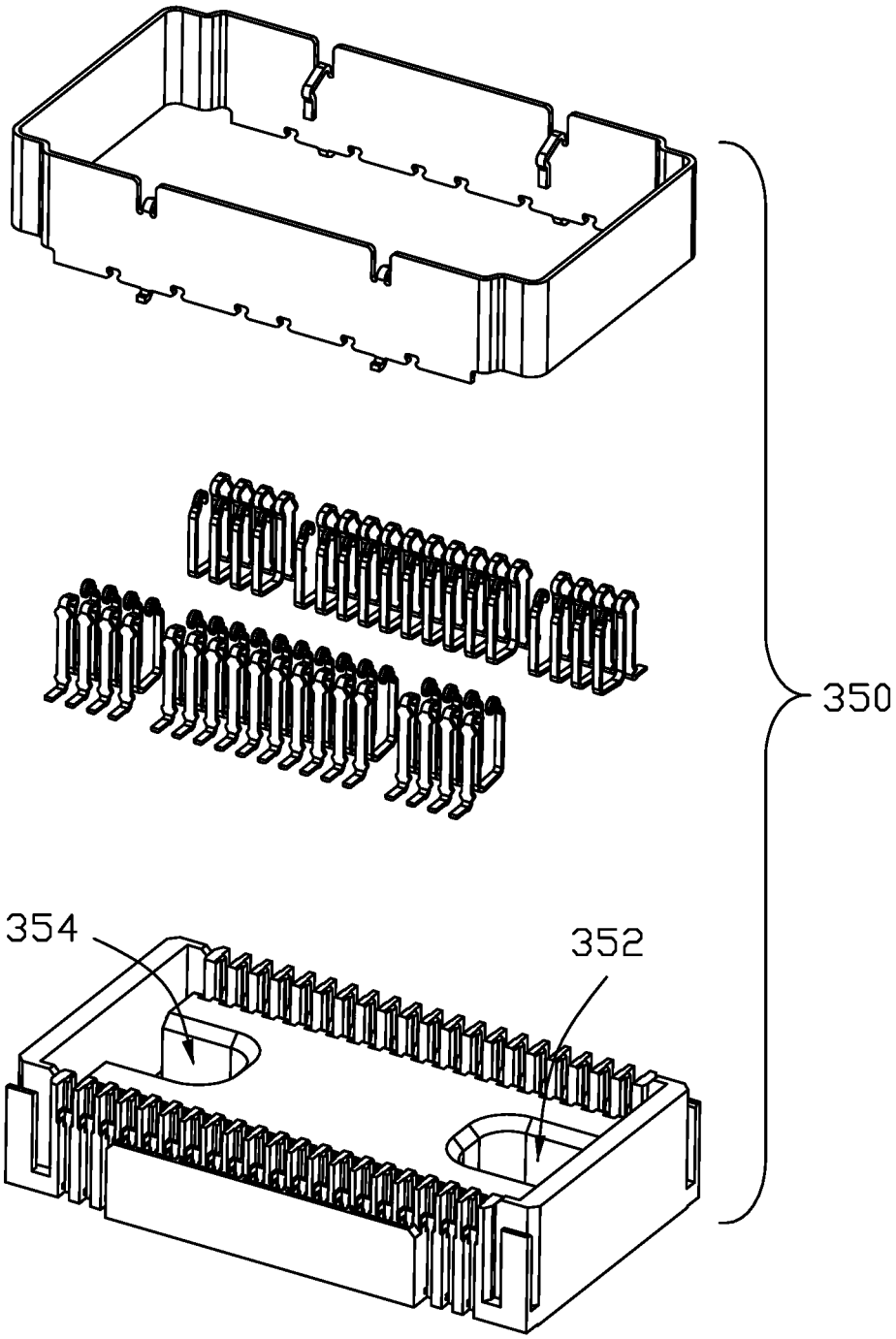
FIG. 13(A) is a downward exploded perspective view of the receptacle connector of FIG. 11(A)
Figure 13B:
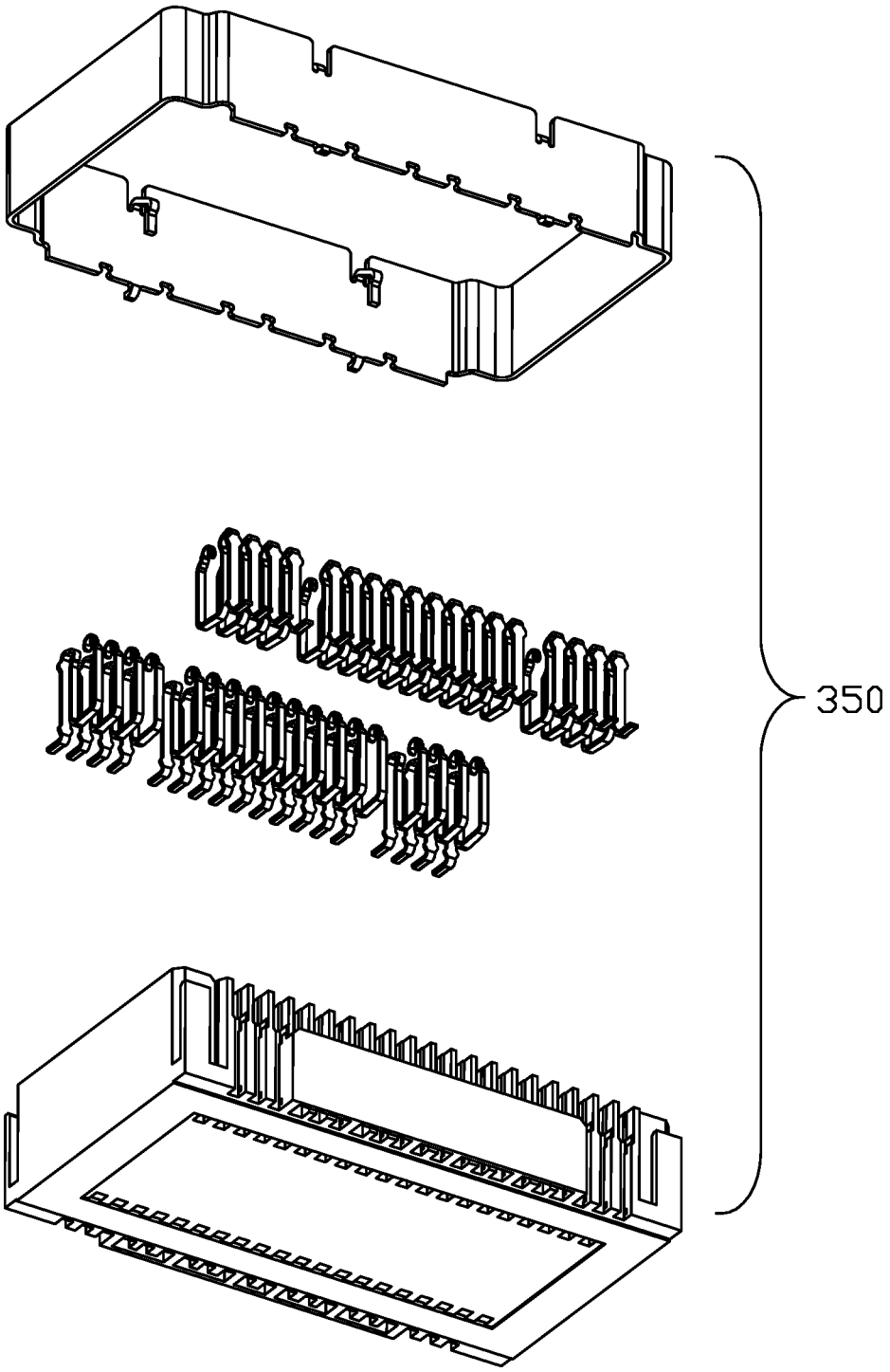
FIG. 13(B) is an upward exploded perspective view of the receptacle connector of FIG. 11(A)
Figure 14A:
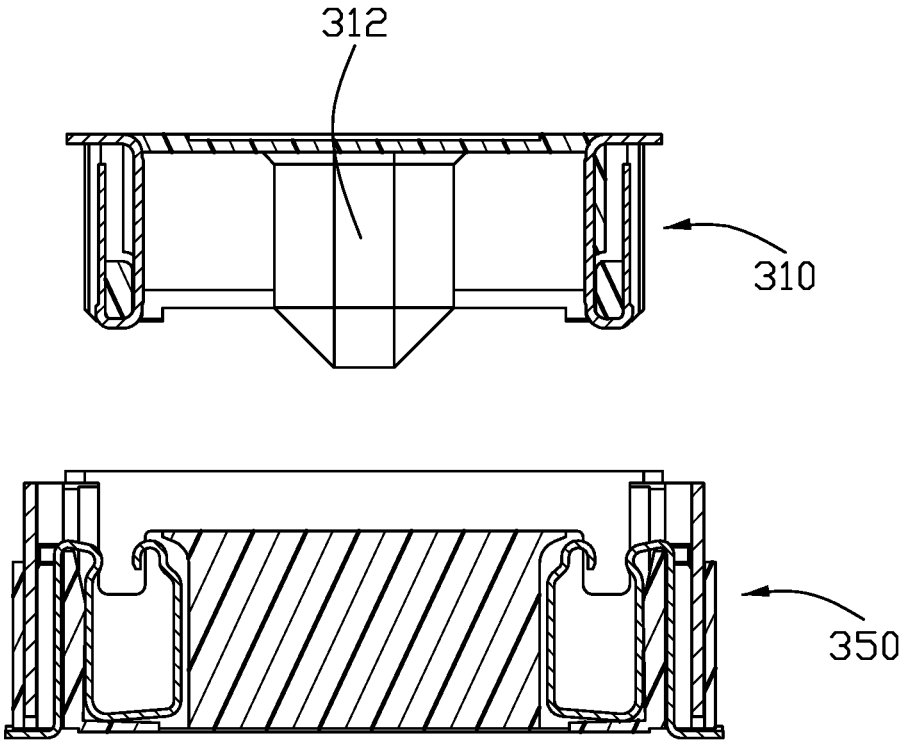
FIG. 14(A) is a cross-sectional view, taken along a transverse plane, of the electrical connector assembly of FIG. 11(A) when the plug connector and the receptacle connector are not mated with each other.
Figure 14B:
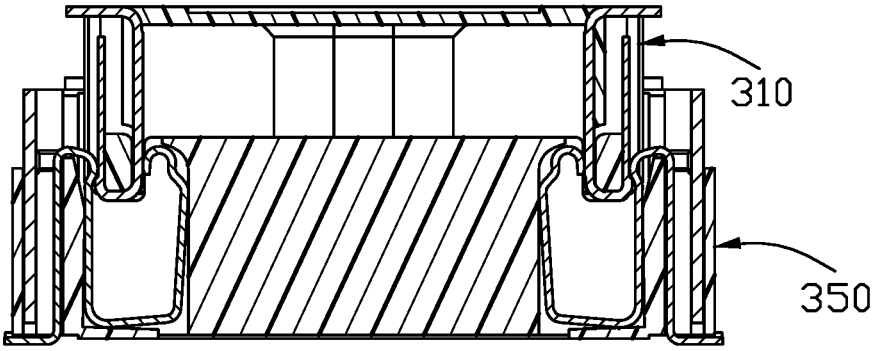
FIG. 14(B) is a cross-sectional view of the electrical connector assembly of FIG. 14(A) when the plug connector and the receptacle connector are mated with each other.
Figure 15A:
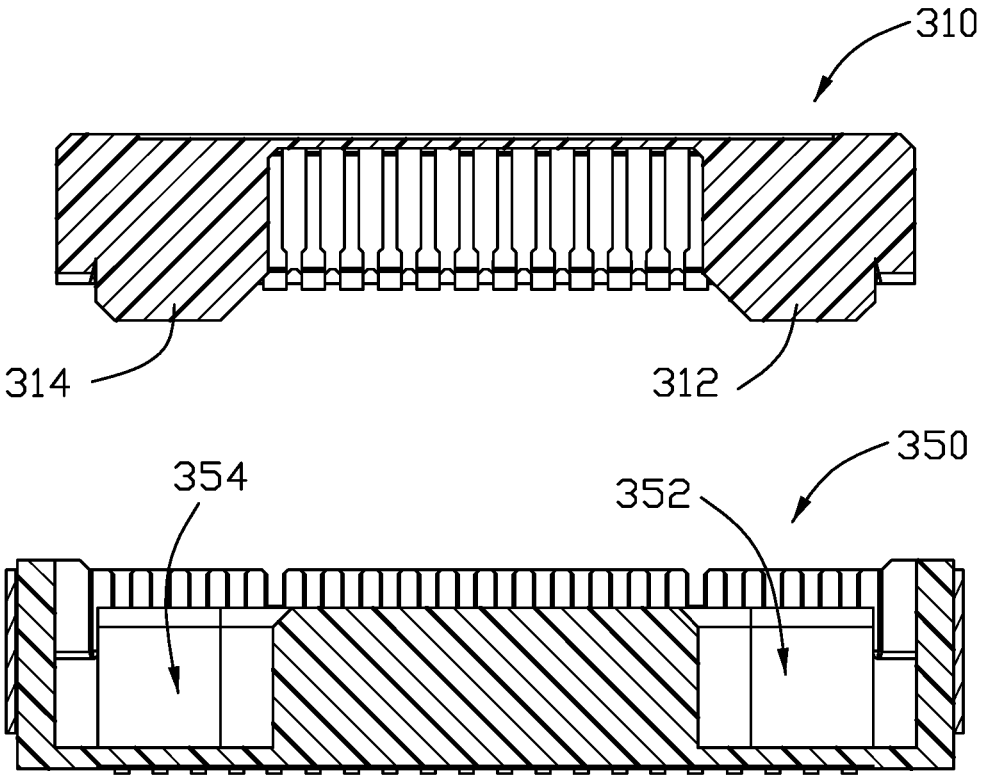
FIG. 15(A) is a cross-sectional view taken along a longitudinal plane, of the electrical connector assembly of FIG. 11(A) when the plug connector and the receptacle connector are not mated with each other.
Figure 15B:
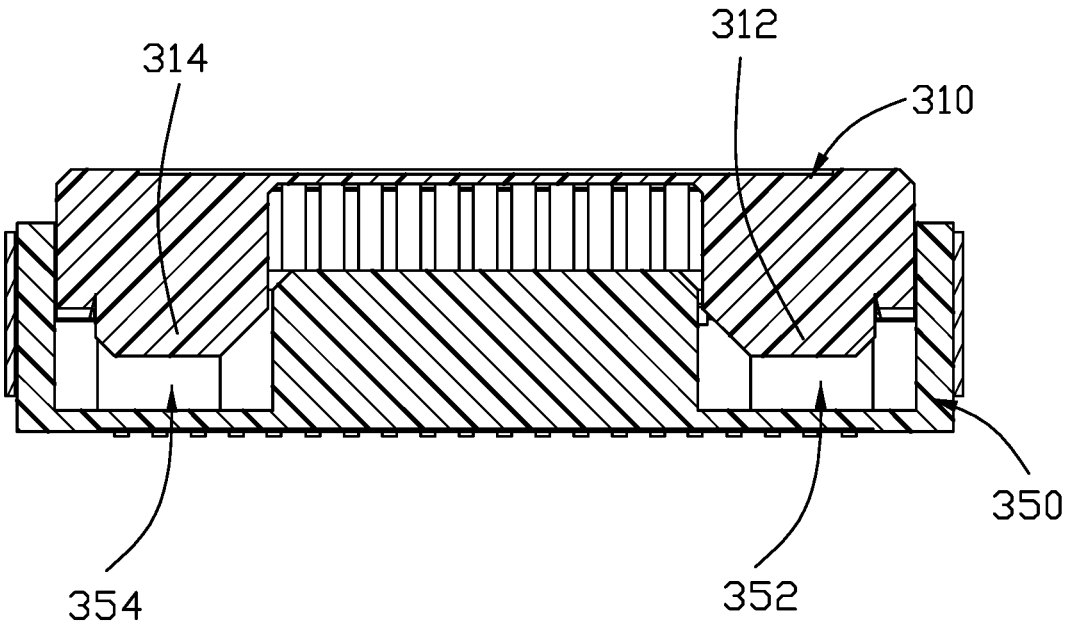
FIG. 15(B) is a cross-sectional view of the electrical connector assembly of FIG. 15(A) when the plug connector and the receptacle connector are mated with each other.

Referring to FIGS. 11(A)-15(B), the electrical connector assembly 30 is similar to the electrical connector assembly 20 including the plug connector 310 and the receptacle connector 350 except that the poles 312 and 314 are same configured/dimensioned and the corresponding holes 352 and 354 are same configured/dimensioned to receive either pole 312 or 314 depending upon how the plug connector 310 and the receptacle connector 350 are is oriented with regard to each other.

Figure 16A:
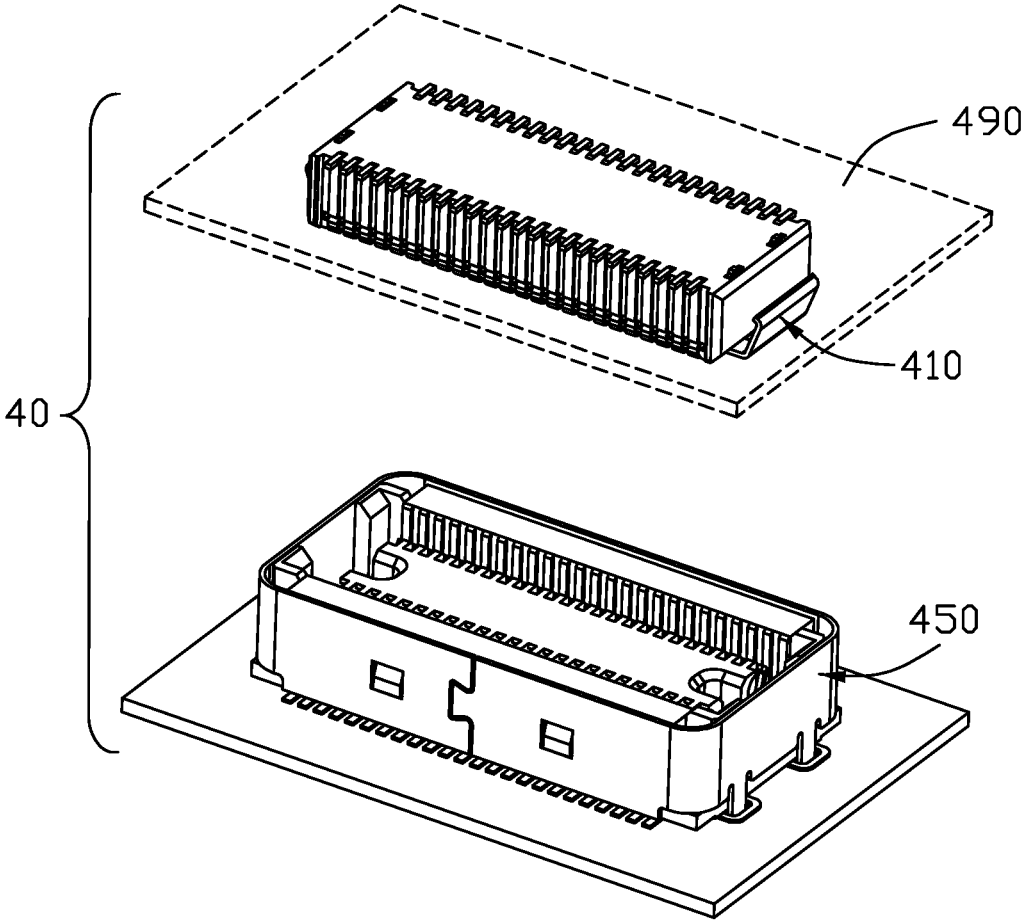
FIG. 16(A) is a downward perspective view of an electrical connector assembly including the receptacle connector and the plug connector respectively mounted upon the corresponding printed circuit boards, respectively, according to a fourth embodiment of the invention.
Figure 16B:
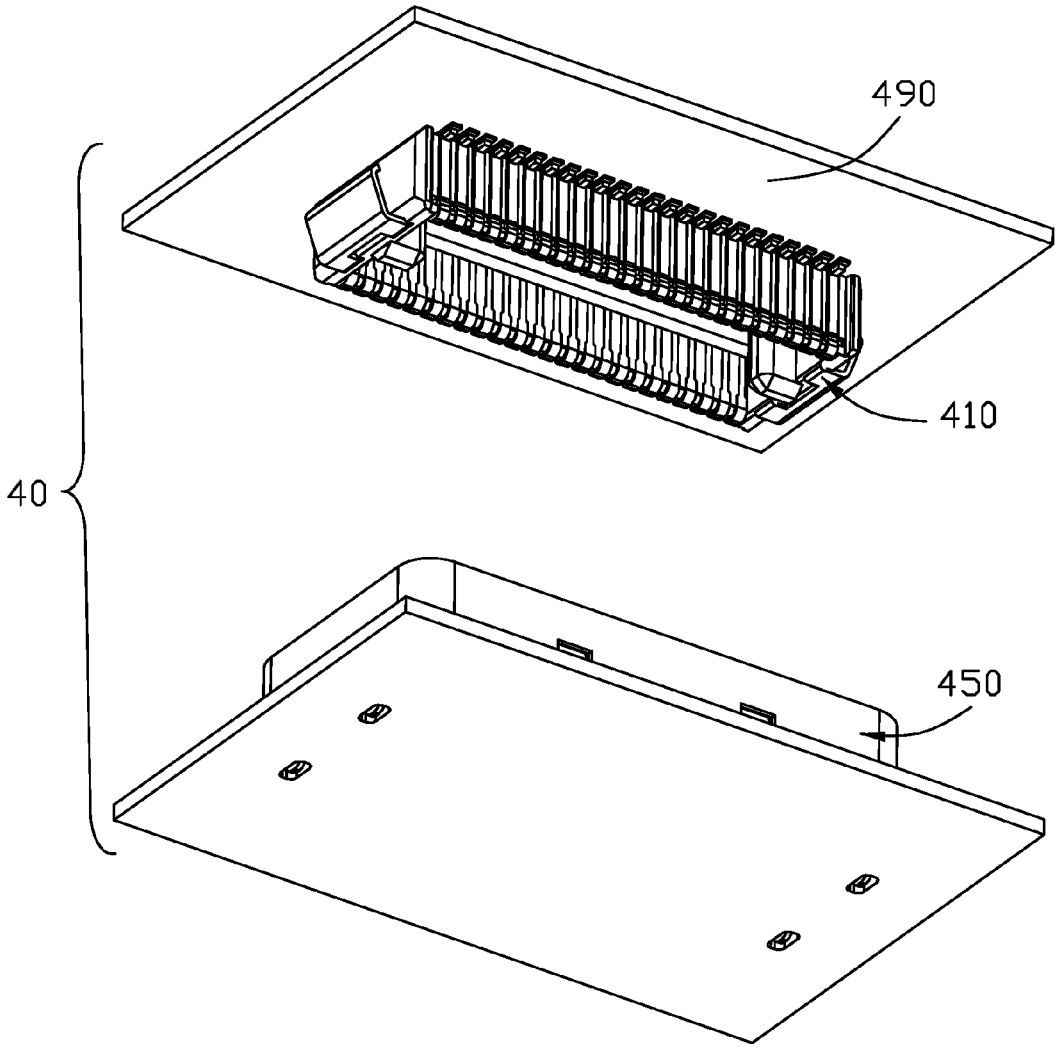
FIG. 16(B) is an upward perspective view of the electrical connector assembly of FIG. 16(A)
Figure 17A:
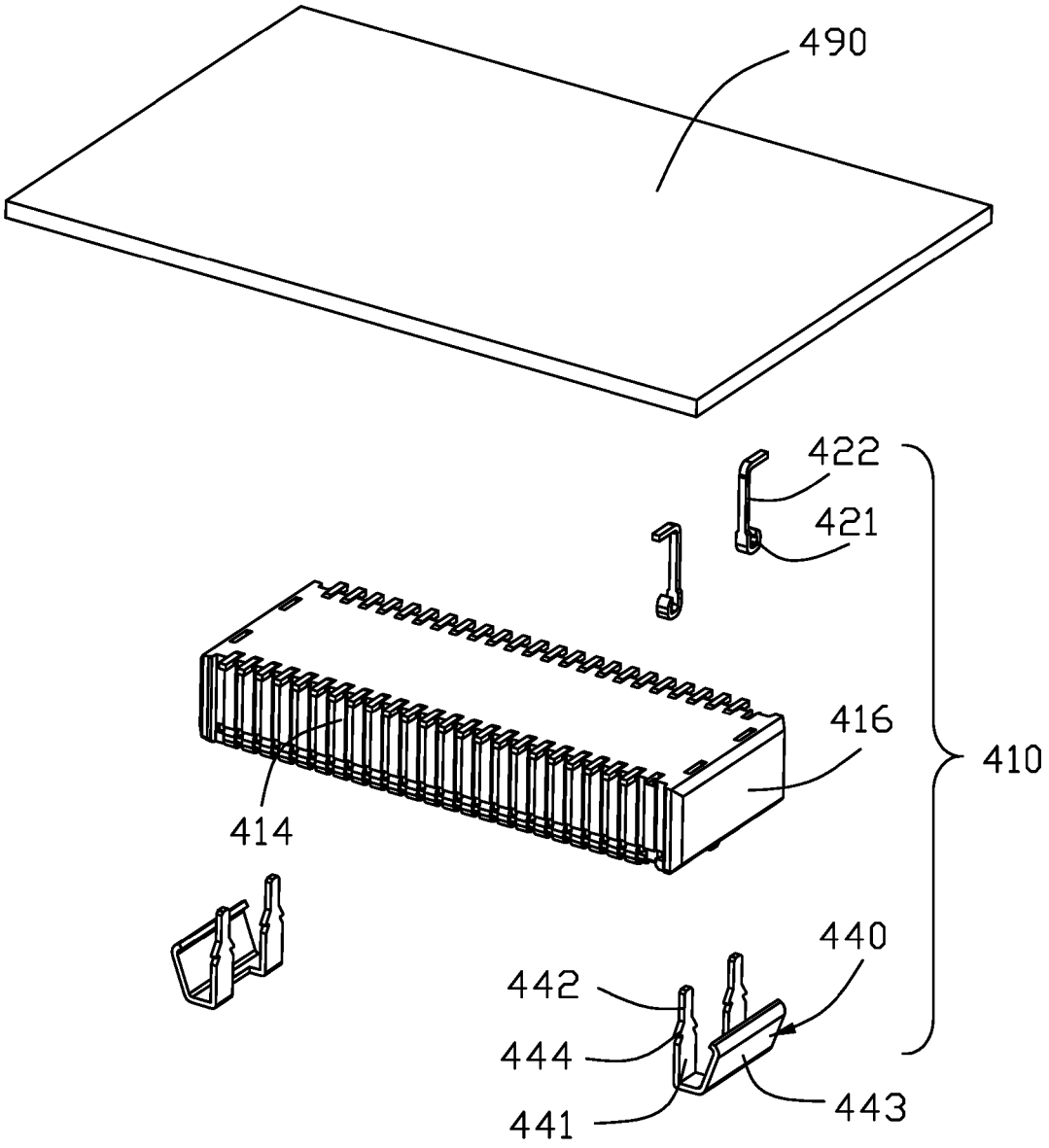
FIG. 17(A) is the downward exploded view of the plug connector and the corresponding printed circuit board of FIG. 16(A)
Figure 17B:
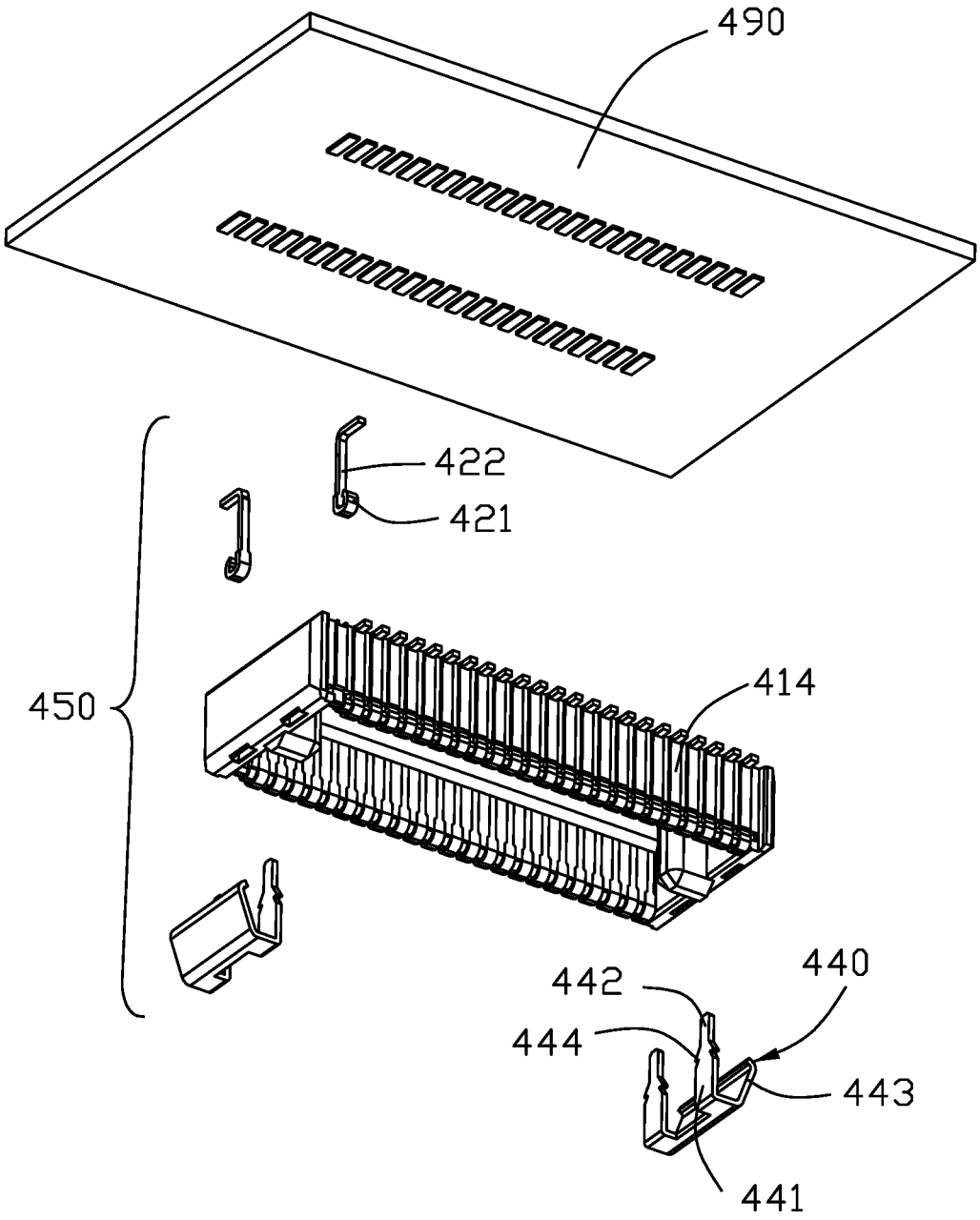
FIG. 17(B) is an upward exploded perspective view of the plug connector and the corresponding printed circuit board of FIG. 17(A)
Figure 18A:
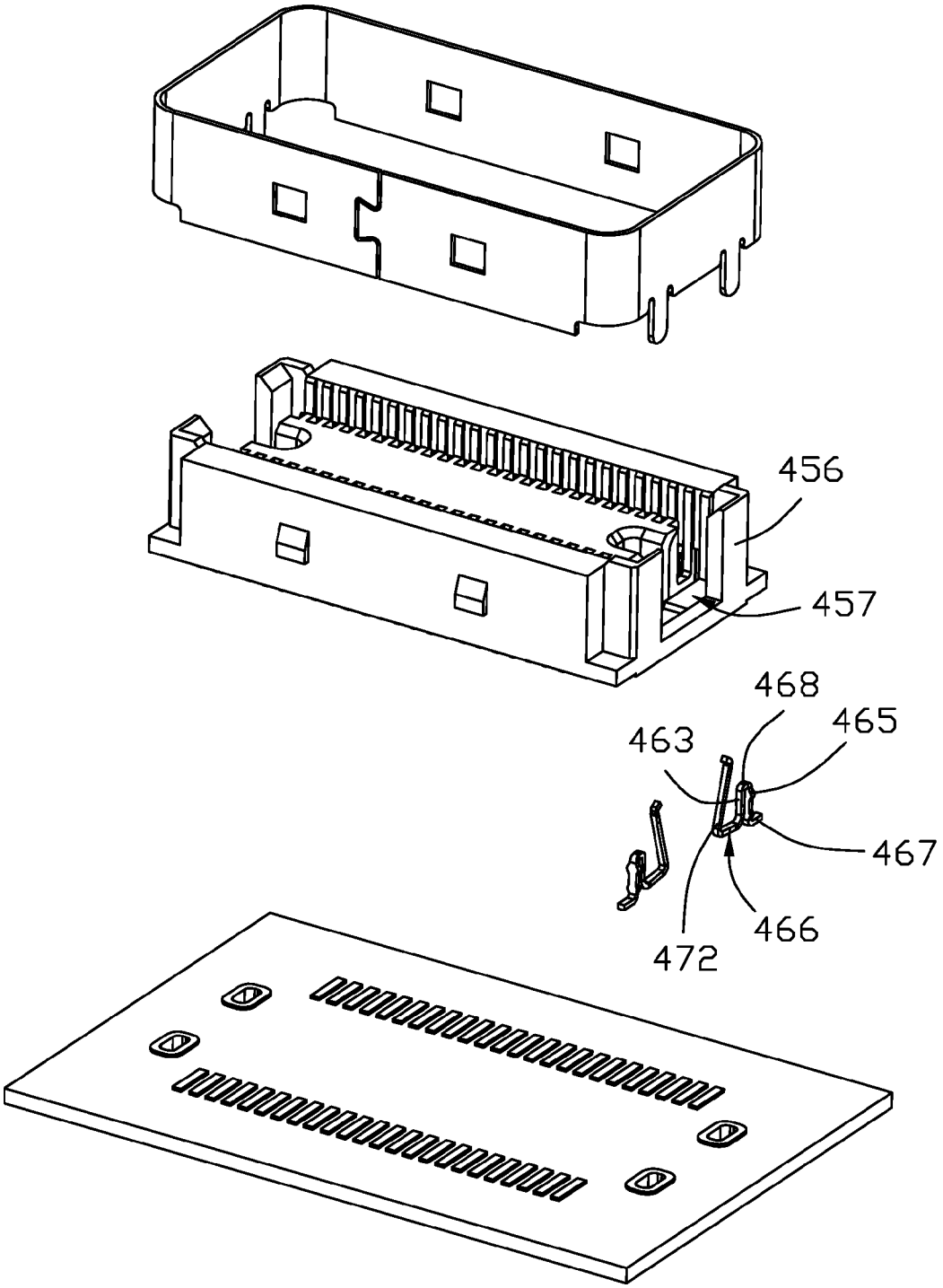
FIG. 18(A) is a downward exploded perspective view of the receptacle connector and the corresponding printed circuit board of FIG. 167(A)
Figure 18B:
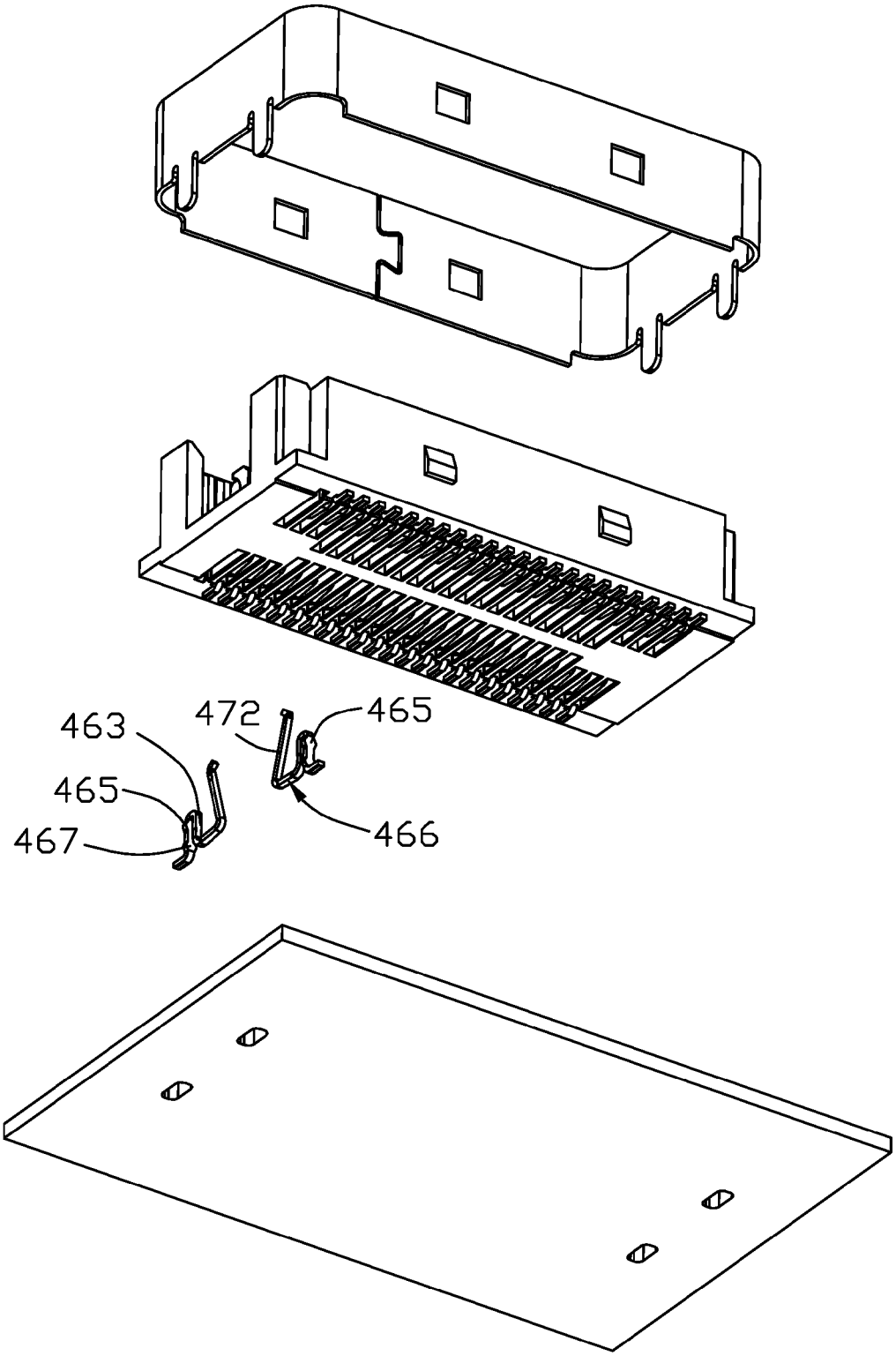
FIG. 18(B) is an upward exploded perspective view of the receptacle connector and the corresponding printed circuit board of FIG. 18(A)
Figure 19:
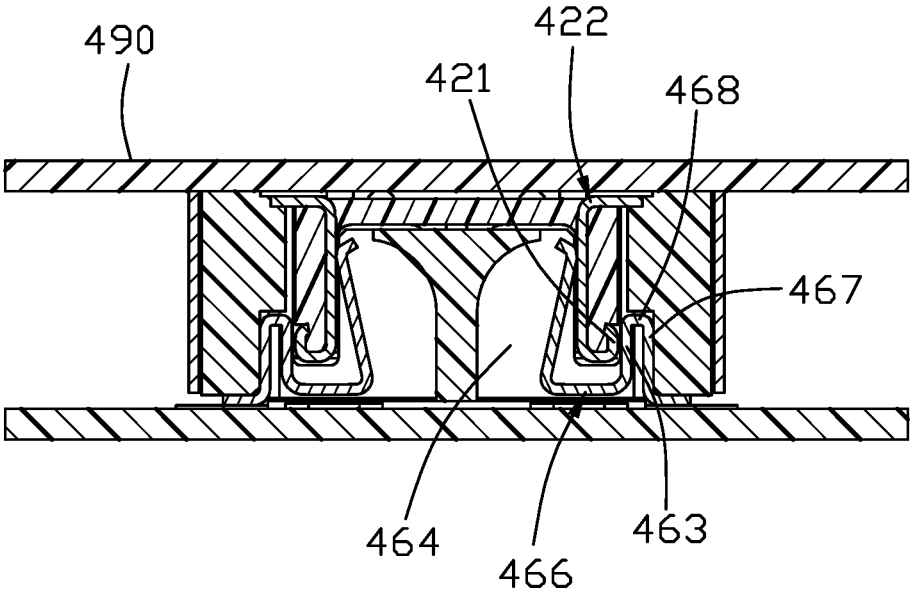
FIG. 19 is a cross-sectional view, taken along a transverse plane, of the electrical connector assembly of FIG. 16(A) when the receptacle connector and the plug connector are mated with each other.
Figure 20:
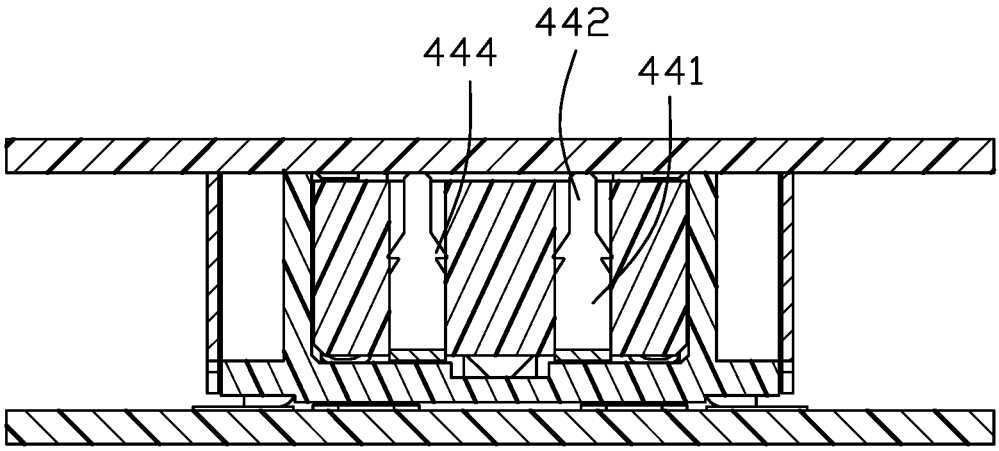
FIG. 20 is another cross-sectional view, taken along another transverse plane, of the electrical connector assembly of FIG. 16(A) when the receptacle connector and the plug connector are mated with each other.

Referring to FIGS. 16(A)-20, the electrical connector assembly 40 is similar to the electrical connector assembly 30 except that the plug connector 410 is further equipped with a pair of grounding tabs 440 attached on two lateral walls 416, and each of the transverse walls 456 of the receptacle connector 450 forms an opening 457 so as to allow the corresponding grounding tab 440 to extend therethrough to mechanically and electrically connect to the metallic shield 472. Each of the grounding tabs 440 includes a body portion 441 with barbs 444 thereon to retain to the housing in an interference fit, a mounting leg 442 extending through the printed circuit board 490 on which the plug connector 410 is seated, and a spring tab 443 resiliently abutting against the metallic shield 472 during mating. Another difference is that the contact 466 of the receptacle connector 450 includes an upside-down U-shaped structure 468 which no longer straddles the lengthwise wall but retained in the passageways 464 via barbs 465 on the outer arm 467 of the upside-down U-shaped structure 468, and is essentially only less than one half of the length of the corresponding passageway 464 in the vertical direction. The inner arm 463 of the upside-down U-shaped structure 468 no longer contacts or locks the corresponding contact 422 of the plug connector 410 wherein the outer arm 421 of the contact 422 is shortened and hidden behind the exterior surface of the longitudinal wall 414 of the housing 412 of the plug connector 410. On the other hand, the contact 466 further includes the extension 472 obliquely extending from the inner arm 469 of the upside-down U-shaped structure 468 to result in a single contact point with the corresponding contact 422 of the plug connector 410.

It is noted that some of the passageways of the receptacle connector are originally laterally exposed to an exterior while being covered by the shield. Four posts around the four corners of the housing of the receptacle connector are not covered by the shield but being exposed to an exterior. Therefore, the four posts cooperate with the bottom portion of the housing to prevent the further downward movement of the shield so as to retain the shield in position.

What is claimed is:

1. An electrical receptacle connector for mating with a plug connector, including:

an insulative housing including a pair of opposite lengthwise walls extending along a longitudinal direction, and a pair of transverse walls extending along a transverse direction perpendicular to said longitudinal direction and cooperating with the opposite lengthwise walls to commonly form a receiving cavity with a center island therein, each of said lengthwise walls forming a middle thickened portion; and two rows of passageways formed in corresponding lengthwise walls of the housing, respectively, and two rows of contacts received in corresponding passageways, respectively; wherein the passageways in the middle thickened portion are covered by the housing in the transverse direction while remaining passageways are not covered by the housing in the transverse direction; further including a metallic shield covering exterior surfaces of the housing to hide said remaining passageways from the exterior in the transverse direction; wherein said shield forms a plurality of contacting tabs mechanically and electrically connecting to the corresponding grounding ones of said contacts, respectively; wherein said shield further forms a plurality of spring tangs extending into the corresponding passageways instead of the corresponding contacts for contacting the plug connector for grounding; wherein said shield further includes a plurality of solder tails aligned with the corresponding spring tangs, respectively, in a vertical direction perpendicular to both said longitudinal direction and said transverse direction, for mounting to a printed circuit board on which the housing is seated; wherein each of said contacts includes an upside-down U-shaped structure and an L-shaped extension unitarily extending from a bottom end of an inner arm of the upside-down U-shaped structure to form a contact region around the center island; wherein a height of said upside-down U-shaped structure in the vertical direction perpendicular to both said longitudinal direction and said transverse direction is less than one half of that of the corresponding lengthwise wall; wherein said contact does not straddle the corresponding lengthwise wall but being upwardly inserted into the corresponding passageway from a bottom face of the housing; wherein said upside-down U-shaped structure forms no contacting region thereon.

2. The electrical receptacle connector as claimed in claim 1, wherein said housing further includes four posts located around four corners and exposed outside of the shield.

3. The electrical receptacle connector as claimed in claim 2, wherein a downward restriction means is formed around a bottom portion of each of said posts for stopping further downward movement of the shield.

4. The electrical receptacle connector as claimed in claim 1, wherein said shield forms a plurality of contacting tabs mechanically and electrically connecting to the corresponding grounding ones of said contacts, respectively.

5. The electrical receptacle connector as claimed in claim 1, wherein an upper end of the inner arm of the upside-down U-shaped structure forms another contact region which also performs a locking function.

6. The electrical receptacle connector as claimed in claim 5, wherein a height of said upside-down U-shaped structure in the vertical direction perpendicular to both said longitudinal direction and said transverse direction, is similar to that of the corresponding lengthwise wall.

7. The electrical receptacle connector as claimed in claim 6, wherein said upside-down U-shaped structure straddles the corresponding lengthwise wall.

8. The electrical receptacle connector as claimed in claim 1, wherein said center island forms a pair of holes for receiving a pair of corresponding poles of the plug connector.

9. The electrical receptacle connector as claimed in claim 8, wherein said pair of holes are diametrically different from each other.

10. The electrical receptacle connector as claimed in claim 9, wherein said pair of holes are lengthened differently from each other in a vertical direction perpendicular to both said longitudinal direction and said transverse direction.

11. The electrical receptacle connector as claimed in claim 10, wherein the pole with a smaller diameter than the other extends longer than the other in the vertical direction.

12. The electrical receptacle connector as claimed in claim 1, wherein each of said transverse walls forms an opening for allowing a corresponding grounding tab of the plug connector to extend therethrough to mechanically and electrically connecting the shield during mating.

13. The electrical receptacle connector as claimed in claim 1, wherein said receiving cavity includes a pair of grooves located by two sides of the center island and each dimensioned with a depth for essentially fully receiving a corresponding longitudinal wall of the plug connector in a vertical direction perpendicular to both said longitudinal direction and said transverse direction so that the shield provides full shielding during mating.

* * * * *